US006983576B2

(12) United States Patent
Ono et al.

(10) Patent No.: US 6,983,576 B2
(45) Date of Patent: Jan. 10, 2006

(54) PACKAGE OF CYLINDRICAL ARTICLES AND METHOD FOR PRODUCING THE SAME

(75) Inventors: Tadashi Ono, Hirakata (JP); Katsuhiko Kumakura, Kyoto (JP); Minoru Kouda, Hirakata (JP); Tomotaka Kawano, Yawata (JP); Shoji Katori, Takatsuki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/970,514

(22) Filed: Oct. 21, 2004

(65) Prior Publication Data

US 2005/0050857 A1 Mar. 10, 2005

Related U.S. Application Data

(62) Division of application No. 09/980,909, filed as application No. PCT/JP00/07253 on Oct. 18, 2000, now Pat. No. 6,820,745.

(30) Foreign Application Priority Data

Nov. 2, 1999 (JP) ..... 11-312738
Mar. 24, 2000 (JP) ..... 2000-085093
Sep. 29, 2000 (JP) ..... 2000-300192

(51) Int. Cl.
*B65B 53/02* (2006.01)

(52) U.S. Cl. ..... 53/442; 53/133.8; 53/398; 53/412

(58) Field of Classification Search ..... 53/133.8, 53/412, 442, 461, 398; 83/695, 660
See application file for complete search history.

(56) References Cited

U.S. PATENT DOCUMENTS

| | | | | |
|---|---|---|---|---|
| 4,166,532 A | | 9/1979 | Tsuchida et al. | |
| 4,333,570 A | | 6/1982 | Heider | |
| 4,641,488 A | * | 2/1987 | Garr | 53/442 |
| 4,696,402 A | | 9/1987 | Harmon et al. | |
| 4,971,197 A | | 11/1990 | Worley | |
| 5,050,368 A | | 9/1991 | Noh | |
| 5,067,612 A | * | 11/1991 | Tsuchiya et al. | 206/497 |
| 5,667,071 A | | 9/1997 | Nakagoshi et al. | |
| 5,797,247 A | | 8/1998 | Nakagoshi et al. | |

FOREIGN PATENT DOCUMENTS

JP 52-64680 5/1977

(Continued)

*Primary Examiner*—Stephen F. Gerrity
*Assistant Examiner*—Hemant M. Desai
(74) *Attorney, Agent, or Firm*—Akin Gump Strauss Hauer & Feld, LLP

(57) ABSTRACT

To retain the virginity of cylindrical articles packed in a cylindrical article package, the present invention provides a package of a novel structure and a fabrication method for the same. More specifically, the present specification discloses a package wherein a film has a slit at least either one of an upper end face and a lower end face of the package in a portion thereof corresponding to a boundary between the adjacent cylindrical articles, and more specifically, a package wherein the film has a slit along the boundary between the adjacent cylindrical articles, and is curved in such a manner as to conform to the outer circumferential surfaces of the cylindrical articles located adjacent to the boundary.

5 Claims, 20 Drawing Sheets

U.S. PATENT DOCUMENTS

| | | | | |
|---|---|---|---|---|
| 6,050,058 | A * | 4/2000 | Loreto et al. | 53/411 |
| 6,105,776 | A | 8/2000 | Meilhon | |
| 6,148,589 | A * | 11/2000 | Fukui et al. | 53/442 |
| 6,513,656 | B2 * | 2/2003 | Hanaoka et al. | 206/497 |
| 6,718,737 | B2 * | 4/2004 | Otsuka et al. | 53/449 |

FOREIGN PATENT DOCUMENTS

| | | | |
|---|---|---|---|
| JP | 6-37175 | U | 5/1994 |
| JP | 8-122981 | A | 5/1996 |
| JP | 9-221170 | A | 8/1997 |
| JP | 10-194244 | A | 7/1998 |

* cited by examiner

PACKAGE OF CYLINDRICAL ARTICLES AND METHOD FOR PRODUCING THE SAME

CROSS-REFERENCE TO RELATED APPLICATIONS

This application is a Divisional of U.S. patent application Ser. No. 09/980,909, filed Dec. 4, 2001 now U.S. Pat. No. 6,820,745 issued on Nov. 23, 2004, which is a 371 of PCT/JP00/07253 filed Oct. 18, 2000, the disclosure of which is incorporated herein by reference.

BACKGROUND OF THE INVENTION

1. Technical Field

The present invention relates to a package containing a plurality of cylindrical articles such as batteries, and a method of fabricating the same.

2. Background Art

Heretofore, various packages for cylindrical articles have been devised and commercialized. In particular, perforations, slits, or the like are formed in wrap films to facilitate removal of the cylindrical articles and to identify that the wrapped cylindrical articles are unused (virginity).

For example, a conventional package is fabricated by wrapping a plurality of articles in a heat-shrinkable film, and heat-shrinking the heat-shrinkable film. In this kind of package, for easy removal of an article to be wrapped, a perforation (opening means) that breaks under force is formed in the portion of the heat-shrunk film that is located in the space between the film and the wrapped articles.

In the conventional method for fabricating such a package, there are two main methods: one is to form a perforation in the heat-shrinkable film before wrapping the film around the cylindrical articles, and the other is to form a perforation in the film after the film has been wrapped and heat-shrunk around the articles. In the former case, it is relatively difficult to position the perforation with respect to the cylindrical articles after wrapping and heat-shrinking. A further problem is that the perforation may be deformed by heating, resulting in decreased package strength or variations in strength from package to package. On the other hand, the latter method has involved the problem that the cylindrical articles may be scratched.

For example, Japanese Unexamined Patent Publication No. Hei 8-122981 discloses a package in which a plurality of cylindrical articles (magazines containing photographic sensitive materials), each packaged in a cylindrical moisture-proof case, are wrapped together by heat-shrinking a heat-shrinkable film around the articles integrally with the moisture-proof case.

Further, Japanese Unexamined Utility Model Publication No. Hei 6-37175 discloses a package which is fabricated by wrapping a plurality of articles to be wrapped in a heat-shrinkable film, and heat-shrinking the heat-shrinkable film. In this package, for easy removal of an article to be wrapped, a perforation (unwrapping means) that breaks under force is formed in the portion of the heat-shrunk film that is located in the space between the film and the wrapped articles.

However, in these packages, since the entire set of cylindrical articles is wrapped in a heat-shrunk film, the cylindrical articles cannot be taken out individually without removing the entire heat-shrunk film. As a result, it is not possible to take out an article individually and yet leave the remaining articles wrapped to retain their unused state (the so-called virginity).

Such a package capable of securing the virginity of each individual cylindrical article is disclosed, for example, in Japanese Unexamined Utility Model Publication No. Sho 52-64680. This package uses a heat-shrinkable film tube of a synthesized resin. The film tube is formed with a slit and/or perforation, and a separating means are formed, spaced apart from one another by a distance equal to the width of each dry battery. According to this publication, after forming the slit, perforation, and separating means, dry batteries are inserted in the film tube in parallel, and then the film tube is heat-shrunk to complete the fabrication of the package.

However, since a heat-shrinkable film tube, in general, is thin and lacks rigidity, if it is attempted to insert dry batteries into the heat-shrinkable film tube with slits, etc. formed in advance, the film may lose its shape and the dry batteries cannot be inserted neatly. Even if the dry batteries could be inserted, wrinkles or folds may be produced in the film tube, impairing the aesthetic appearance of the package. Furthermore, since the slit portions of the film are in the so-called idle state, when broken to separate each individual article, the perforated portions of the film become loose and the film is unable to fix and retain the wrapped cylindrical articles in a reliable manner.

That is, with the method of the above publications, it has not been possible to reliably obtain a package capable of ensuring the virginity of each individual cylindrical article.

Also in these days, it is desired to increase the number of batteries that can be packed in such a package, but if many batteries are packed in one package, all the batteries will come out separated upon opening the package, which inconveniences the consumer.

To address this problem, it has been practiced to employ a packing method generally known as the double shrink packing method in which a plurality of unit packages, each containing a plurality of batteries, are arranged and wrapped together in a second heat-shrinkable film (outer film). In one example, such a composite package is fabricated by arranging three unit packages in parallel, each containing four batteries, and wrapping them together in a second heat-shrinkable film.

However, since the total weight of the plurality of unit packages is considerably high, high strength is required for the second heat-shrinkable film to fix and retain them. This gives rise to the problem that the package is difficult to be opened because a relatively strong force is needed to open the package containing the plurality of unit packages.

In view of the above-outlined problems, it is an object of the present invention to provide a package for a plurality of cylindrical articles, capable of removing each cylindrical article individually and retaining the virginity of each remaining article even when the cylindrical articles are removed one by one.

It is another object of the present invention to provide a package for cylindrical articles and a method of fabricating the same, in which a slit can be easily formed in a boundary portion between adjacent cylindrical articles as well as in the upper end and lower end faces of the package without scratching or nicking the cylindrical articles.

It is a further object of the present invention to provide a package (double shrink package) fabricated using the above so-called double shrink packing method, in which the package permits each individual unit package to be removed by easily breaking the outer film while reliably and stably maintaining the fixed and retained state of the unit package.

BRIEF SUMMARY OF THE INVENTION

The present invention relates to a package for cylindrical articles, fabricated by wrapping a plurality of cylindrical articles assembled in parallel in a heat-shrinkable film, and heat-shrinking the film to fix and retain the articles, wherein the film has a slit on at least either one of an upper end and lower end faces of the package corresponding to an upper end and a lower end of the cylindrical articles and in a portion thereof corresponding to a boundary between the adjacent cylindrical articles.

The invention also relates to a method of fabricating a package for cylindrical articles, the package being fabricated by wrapping a plurality of cylindrical articles assembled in parallel in a heat-shrinkable film, and heat-shrinking the film to fix and retain the articles, the fabrication method comprising a step (a) of moving a V-shaped or U-shaped cutting jig with a double-sided blade up and down on the heat-shrinkable film located on an upper end face and/or lower end face of the package corresponding to the upper end and/or lower end of the cylindrical articles, and thereby forming slits in the heat-shrinkable film located at the upper end face and/or lower end face at a boundary between the adjacent cylindrical articles.

It is effective that the fabrication method comprises a step (b) of forming a perforation in the heat-shrinkable film located on a side of the package, in which the cylindrical articles assembled in parallel are packed, along the boundary between the adjacent cylindrical articles.

It is also effective that the method further comprises a step (c) of forming a perforation in the heat-shrinkable film located in outermost portions of the upper end and lower end faces of the package along the boundary between the adjacent cylindrical articles.

Further, it is effective that the slit forming step (a) is performed after performing the perforation forming step (b).

Further, it is effective that the step (b) and the step (c) are performed simultaneously.

The invention also relates to a package for cylindrical articles, fabricated by wrapping a plurality of cylindrical articles assembled in parallel in a heat-shrinkable film, and heat-shrinking the film to fix and retain the articles, wherein the film has a slit on a side of the package along a boundary between the adjacent articles, and is curved in such a manner as to conform to outer circumferential surfaces of the cylindrical articles located adjacent to the boundary.

In this case, it is effective that the package includes an adhesive layer formed at least on inner surface of the film on a periphery of the slit.

Further, it is effective that the adhesive layer is made of a heat sensitive adhesive agent.

Further, it is effective that the slit is formed in the film on each side of the package.

Further, it is effective that the layer of the slit is dimensioned within a prescribed range determined so that each individual cylindrical article does not fall out of the package even when the package is dropped.

Further, it is effective that the package includes a perforation that connects the slit formed on one side of the package to the slit formed on the other side of the package.

Further, it is effective that the slit is formed in the film on one side of the package, and a perforation connecting both ends of the slit is formed in the film on the other side of the package.

Further, it is effective that the film is in the form of a sheet, and forms a welded portion at end portions thereof to wrap the articles together, and the welded portion is positioned on one side of the package.

Further, it is effective that the film is in the form of a tube.

The invention also relates to a method of fabricating a package for cylindrical articles, the package being fabricated by wrapping a plurality of cylindrical articles assembled in parallel in a heat-shrinkable film, and heat-shrinking the film to fix and retain the articles, wherein the film has a slit on a side of the package along a boundary between the adjacent articles, and is curved in such a manner as to conform to outer circumferential surfaces of the cylindrical articles located adjacent to the boundary, the fabrication method comprising the steps of: (A) forming the slit and/or a perforation in the heat-shrinkable film in such a manner that the slit and/or the perforation are located in designated positions along the boundary between the adjacent cylindrical articles; (B) wrapping the plurality of cylindrical articles assembled in parallel in the film; (C) cutting the film; (D) heat-shrinking the film which wraps the cylindrical articles; and (E) curving the heat-shrinkable film along the boundary in such a manner as to conform to the outer circumferential surfaces of the adjacent cylindrical articles.

The invention further relates to a composite battery package in which a plurality of unit packages, each fixing and retaining a plurality of batteries assembled in a parallel in a first heat-shrinkable film, are fixed and retained in a second heat-shrinkable film in parallel, at least one pore being formed in the second heat-shrinkable film in a portion thereof corresponding to an end portion of a boundary between the packages.

In this composite battery package, it is effective that the pore is provided at each end portion of the boundary on each side of the package.

Also, it is effective that the first heat-shrinkable film has a higher melting point than that of the second heat-shrinkable film.

DETAILED DESCRIPTION OF THE INVENTION

The present invention can be carried out in various modes to accomplish the above-described objects. Embodiments of the present invention will be described in detail below.

Embodiment 1

Embodiment 1 of the present invention relates to a package for cylindrical articles, fabricated by wrapping a plurality of cylindrical articles assembled in parallel in a heat-shrinkable film, and heat-shrinking the film to fix and retain the articles, wherein the film has a slit in a portion thereof corresponding to a boundary between the adjacent cylindrical articles, the slit being formed on at least either one of an upper end face and a lower end face of the package corresponding to upper end and lower end faces of the adjacent cylindrical articles.

To resolve the earlier described problems, the present invention provides a method of fabricating a package for cylindrical articles, the package being fabricated by wrapping a plurality of cylindrical articles assembled in parallel in a heat-shrinkable film, and heat-shrinking the film to fix and retain the articles, the fabrication method comprising a step (a) of moving a V-shaped or U-shaped cutting jig with a double-sided blade up and down on the heat-shrinkable film located on the upper end and lower end faces of the package, and thereby forming slits in the heat-shrinkable film located on the upper end and lower end faces at the boundary between the adjacent cylindrical articles.

More specifically, as a method of forming a perforation in the method of fabricating the package for cylindrical articles, the present invention employs a method of forming a perforation in the film after wrapping, for easy positioning and stable formation thereof with a uniform length. The most remarkable feature of the invention is that a blade having a special shape is used to form the slits on the upper end and lower end faces of the package without scratching the cylindrical articles.

The fabrication method in accordance with the present invention will be described below in the order of processing steps, along with the blade having such a special shape.

In the present invention, a cylindrical article package yet to be provided with a perforation or a slit is produced first. The method of producing this package is not specifically limited, but for example, an entire set of cylindrical articles assembled in parallel is wrapped in a heat-shrinkable film such as a polyethylene terephthalate (PET) film, and then the film is heat-shrunk around the articles to form a package in which the cylindrical articles are fixed and retained.

Figure 1:
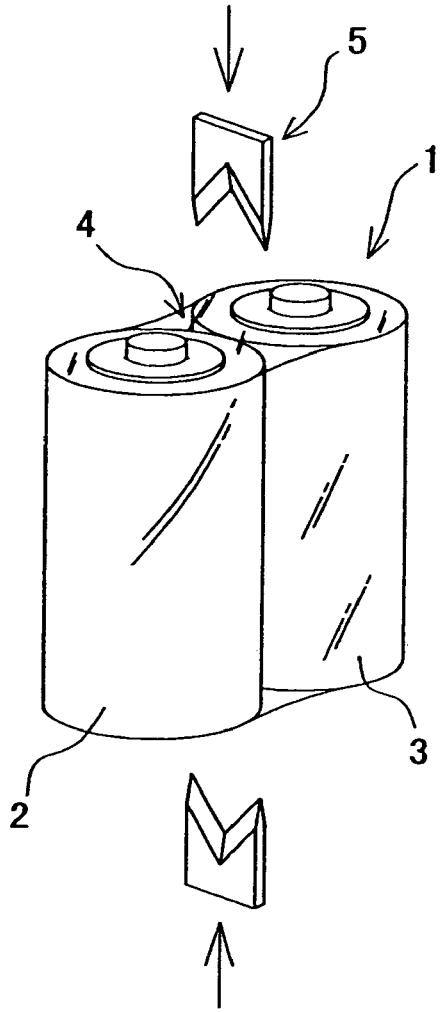
FIG. 1 is a schematic diagram for explaining a slit forming step in accordance with the present invention.

Next, in the package fabrication method of the invention, as shown in FIG. 1, a cutting jig 5 is moved up and down on the heat-shrunk film located on the upper end and lower end faces of a package 1 along a boundary 4 between adjacent cylindrical articles 2 and 3. FIG. 1 is a schematic diagram for explaining the slit forming step in accordance with the present invention.

Figure 2:
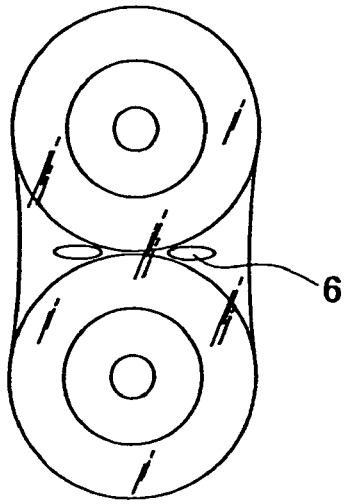
FIG. 2 is a top plan view of a package provided with slits in FIG. 1.

Then, as shown in FIG. 2, slits 6 are formed in the heat-shrunk film located on the upper end and lower end faces of the package. FIG. 2 shows a top plan view of the package 1 provided with the slits 6.

V-shaped or U-shaped cutting jigs 5 with a double-sided blade in accordance with the present invention will be described below.

Figure 3:
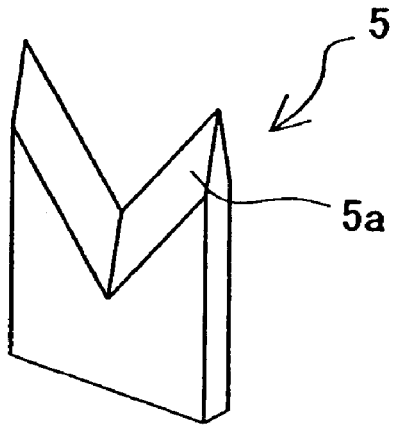
FIG. 3 is a schematic perspective view of a V-shaped cutting jig with a double-sided blade in accordance with the present invention.
Figure 4:
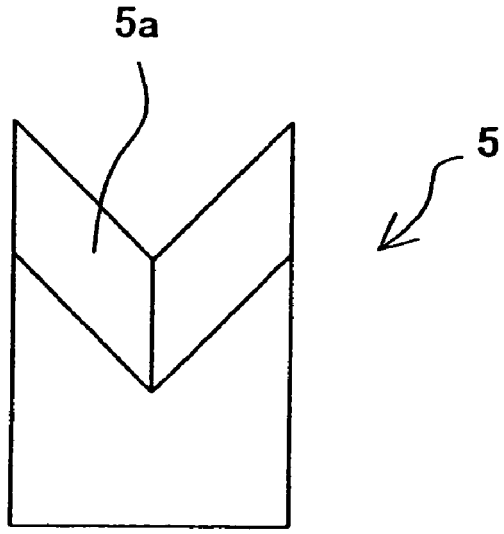
FIG. 4 is a front view of the cutting jig shown in FIG. 3.

FIG. 3 is a schematic perspective view of a V-shaped cutting jig 5 with a double-sided blade, and FIG. 4 is a front view of the cutting jig 5 shown in FIG. 3. As shown in FIG. 4, the cutting jig 5 of the present invention is V-shaped, and as shown in FIG. 3, the blade 5*a* has cutting edges each sharpened so as to form an acute angle between the two sides. In other words, the blade 5*a* is provided inwardly in the form of V, and the left and right blade portions form double-sided sharpened cutting edges.

When the V-shaped cutting jig 5 having such double-sided sharpened cutting edges is moved up and down on the upper end face of the package, as shown in FIG. 1, the V-shaped blade 5*a* cuts into the film from above, piercing the film with the V-shaped pointed ends and forming the slits 6 starting from the outside and cutting toward the center.

That is, since the cutting jig 5 having the above-described shape cuts well, it can cut easily into the film. Further, since, in the upper end or lower end face of the package, each cutting edge moves in such a manner as to slide from the outside toward the center along a curve (arc) defining the outer circumference of each cylindrical article, each slit 6 can be formed easily without the cutting edge scratching the outer circumference (the label in the case of a battery) of each cylindrical article.

Further, by using the blade 5*a* having double-sided sharpened edges, slits of stable shape can be formed. That is, when forming the slits, the cutting jig 5 is moved up and down on the film to cut into the film; at this time, when the blade 5*a* cuts into the film, each double-sided cutting edge of the blade 5*a* spreads the slit by applying a uniform pressure on both the left and right sides of the slit, thereby forming a straight slit. On the other hand, in the case of a single-sided blade, the spreading force is not balanced between the left and right sides of the slit, so that the slit may be formed obliquely.

The length of each slit cutting toward the center in the upper end and lower end faces can be varied as desired according to the strength of the package by appropriately controlling the position of the cutting jig 5 to be moved up and down on the package.

Further, when the blade 5*a* having double-sided sharpened edges is used, the sides of the blade 5*a* of the cutting jig 5 are easy to move tangentially along the curved (arced) outer circumferential surfaces of the cylindrical articles, the effect of this being that the blade 5*a* is less likely to cut into the circumferential surfaces of the cylindrical articles. In particular, if the cutting jig 5 is brought too close to the upper end face at the boundary between the adjacent cylindrical articles, since the V-shaped blade 5*a* moves toward the center by pushing its way through the left and right adjacent cylindrical article, the blade 5*a* is less likely to scratch the cylindrical articles. Further, on the upper end and lower end faces, each slit can be formed as closest as possible to the contact point between the adjacent cylindrical articles without scratching or nicking the cylindrical articles.

Figure 5:
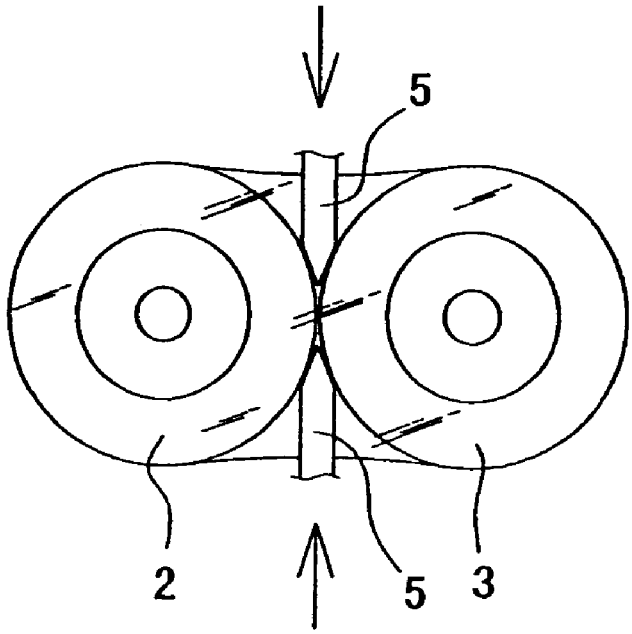
FIG. 5 is a schematic diagram showing the cutting jig of the invention being brought close to the space between adjacent cylindrical articles.
Figure 6:
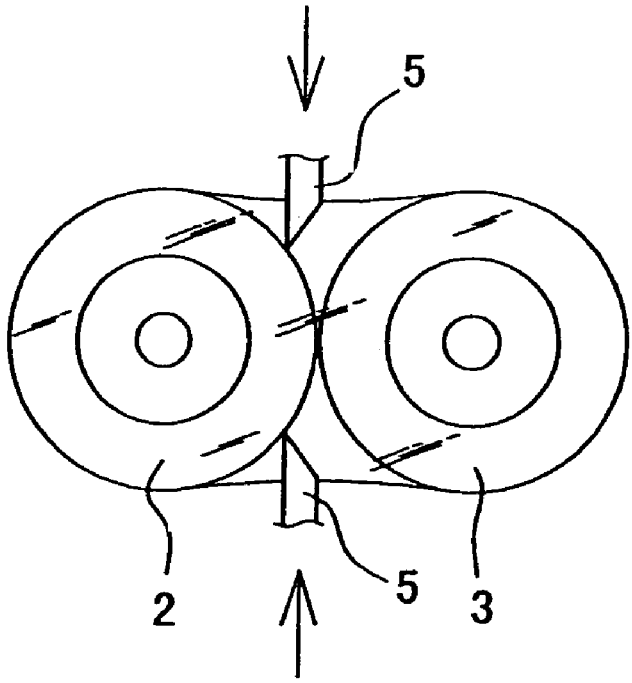
FIG. 6 is a schematic diagram showing a cutting jig with a single-sided blade being brought close to the space between adjacent cylindrical articles.

FIG. 5 shows how this is done. FIG. 5 is a schematic diagram conceptually illustrating how the cutting jig 5 can be brought close to the space between the adjacent cylindrical articles 2 and 3; the cutting jig 5 shown here has the double-sided sharpened blade 5*a* in accordance with the present invention. On the other hand. FIG. 6 is a schematic diagram conceptually showing a cutting jig 5 with a non-sharpened single-sided edge being brought close to the cylindrical articles.

As can be seen from a comparison between the schematic diagrams of FIGS. 5 and 6, when the cutting jig 5 of the present invention shown in FIG. 5 is used, both sides of the sharpened blade 5*a* move tangentially along the curvatures of the outer circumferential surfaces of the cylindrical articles 2 and 3, successfully entering the space between the cylindrical articles 2 and 3 without scratching the cylindrical articles 2 and 3. On the other hand, as shown in FIG. 6, when the cutting jig 5 with a single-sided blade is used, the edges tend to scratch the cylindrical article 2.

Figure 7:
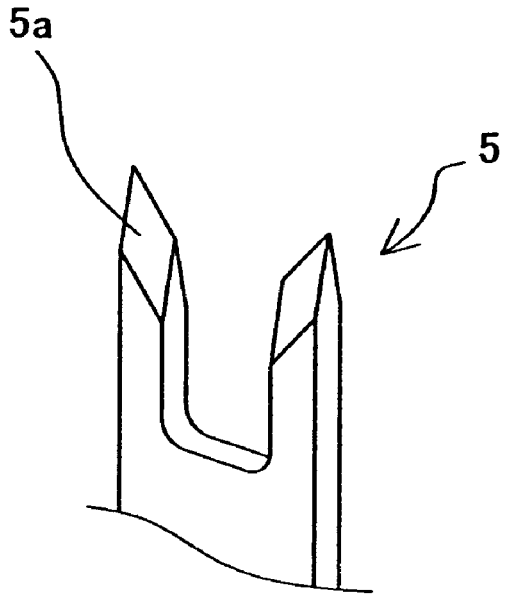
FIG. 7 is a schematic perspective view of a U-shaped cutting jig with a double-sided blade in accordance with the present invention.
Figure 8:
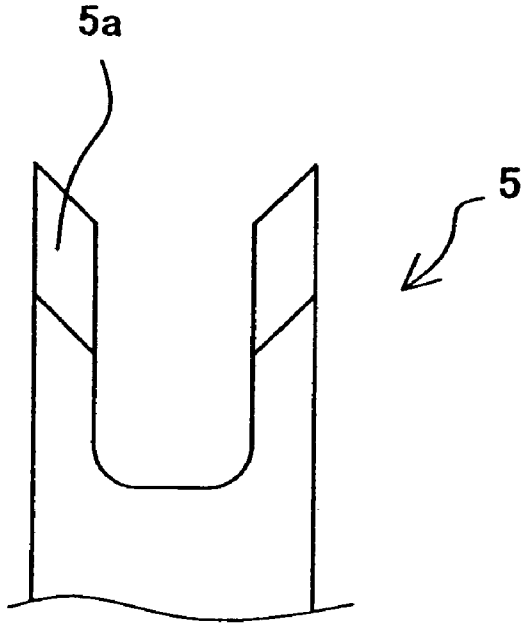
FIG. 8 is a front view of the cutting jig shown in FIG. 7.

In FIGS. 3 and 4, the cutting jig 5 has been shown as being shaped in the form of a V, but in the present invention, a U-shaped cutting jig may be used. FIG. 7 is a schematic perspective view of a U-shaped cutting jig 5 with a double-sided blade, and FIG. 8 is a front view of the cutting jig 5 shown in FIG. 7.

With the cutting jig 5 having such a U-shaped form, the same effect as achieved with the V-shaped cutting jig 5 described above can be obtained.

The dimensions of the cutting jig 5 should be determined appropriately according to the dimensions of the cylindrical articles contained in the package (in the case of dry batteries, the battery size).

Figure 9:
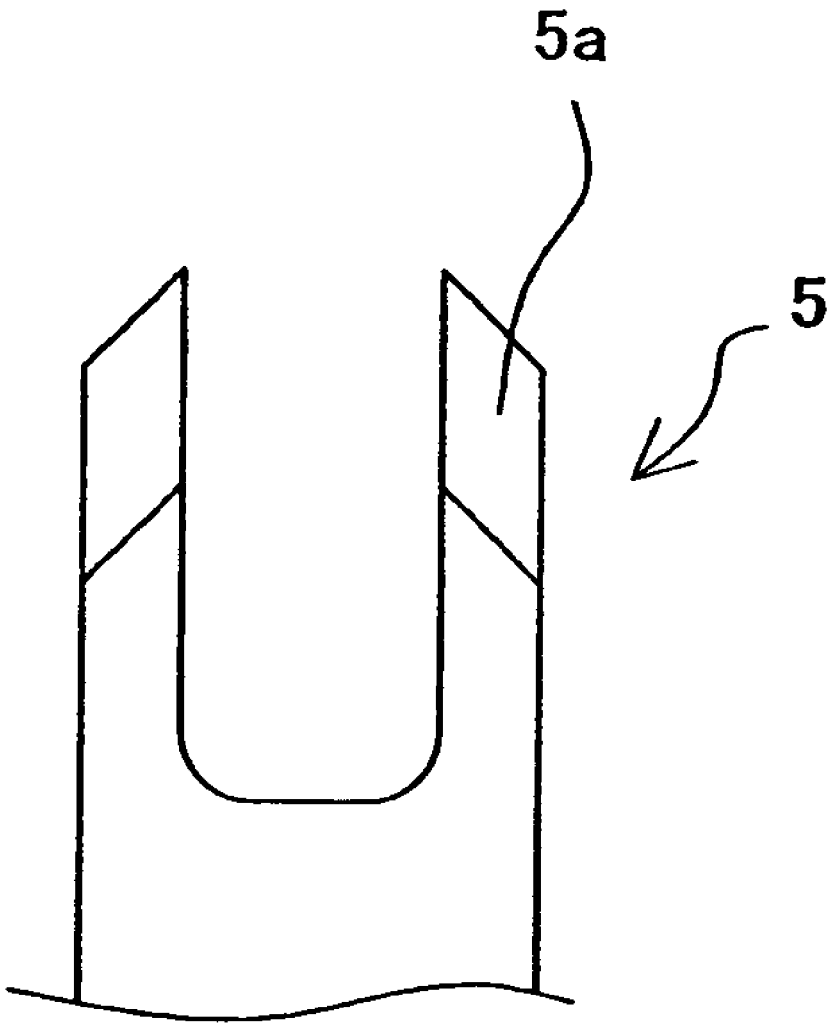
FIG. 9 is a front view of another U-shaped cutting jig with a double-sided blade in accordance with the present invention.

A U-shaped cutting jig having an outwardly facing blade 5*a*, as shown in FIG. 9, can also be used. FIG. 9 is a front view showing a U-shaped cutting jig in such an example.

The package fabrication method of the present invention preferably comprises a step (b) of forming a perforation in the heat-shrunk film located on a side of the package along the boundary between the adjacent cylindrical articles.

The most remarkable feature of the invention lies in the slit forming method described above, but for easy separation of each individual cylindrical article from the package, it is preferable to provide a perforation on the side of the package along the boundary between the adjacent cylindrical articles, and this is because the perforation permits the film to be torn precisely along a prescribed direction while leaving, after separation, the virginity-proving film wrapped around each of the individual cylindrical articles forming the package.

The perforation forming method is not specifically limited, and any conventionally known method can be employed; however, since the cutting jig 5 is used to form slits as described above, it is preferable to use a comb-like perforating jig such as the one shown in the examples described below, and operate it in a manner similar to the operation of the cutting jig 5 to form the slits. The reason that the comb-like perforating jig is used here is that, in the case of a sawtooth-like jig having a plurality of convex-shaped cutting teeth, if the film contains a curved portion or a loose portion, a uniform perforation cannot be formed and, as a result, the film tends to lose the ability to be torn properly.

The perforation may also be formed in the heat-shrunk film in the outermost portions of the upper and lower ends of the package at the boundary between the adjacent cylindrical articles (step (c)).

Although the details will be described in the examples given below, in the above-described method, the slit forming step (a) may be performed after performing the perforation forming step (b), and further, the fabrication process can be shortened by performing the steps (b) and (c) simultaneously.

In the following, the package fabrication method in accordance with the present invention will be described concretely with reference to specific examples, but it is not limited thereto.

EXAMPLE 1

A package containing two D size dry batteries was produced by wrapping the two dry batteries in a heat-shrinkable film of polyethylene terephthalate, and by heat-shrinking the film around the batteries.

Figure 10:
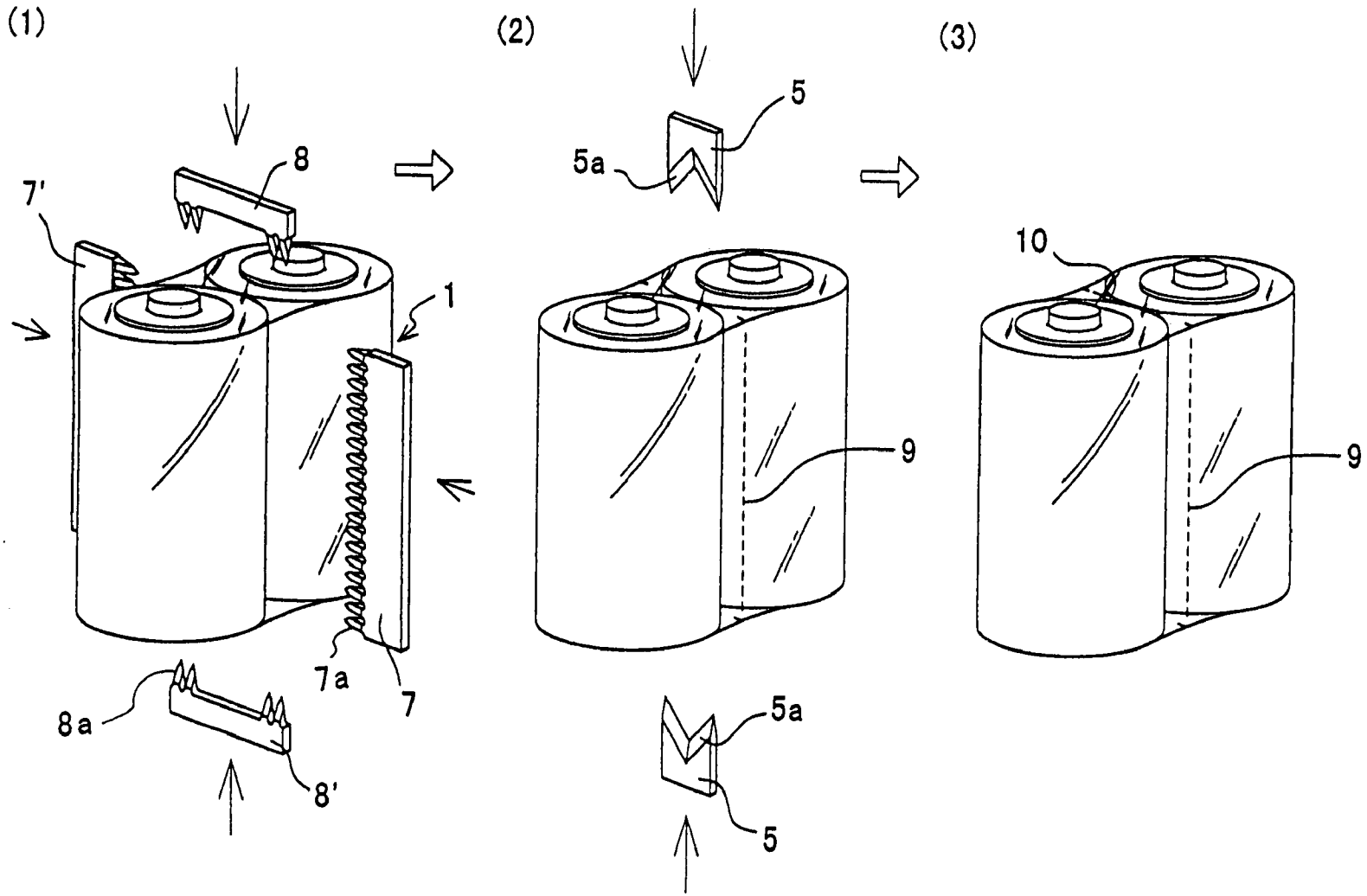
FIG. 10 is a schematic diagram for explaining the steps of forming perforations and slits in a package fabrication method in accordance with the present invention.

Next, the perforation forming and slit forming steps shown in FIG. 10 were performed. FIG. 10 is a schematic diagram for explaining the steps of forming perforations and slits in the package fabrication method in accordance with the present invention.

First, as shown in part (1) of FIG. 10, first perforating jigs 7 and 7' were brought close to the sides of the package 1 containing the two dry batteries, and perforations 9 were formed along the boundary between the adjacent dry batteries contained in the package 1. The perforating jigs 7 and 7' have comb-like teeth 7*a* with which the perforations 9 are formed in the heat-shrunk film on the respective sides of the package 1. The size and pitch of the teeth were determined so that the perforations would not break and each individual cylindrical article would not be released when the package was dropped on the ground.

At the same time, as shown in part (1) of FIG. 10, second perforating jigs 8 and 8' ere brought close to the upper end and lower end faces of the package 1 at the boundary between the adjacent dry batteries 2 and 3, and perforations were formed in the heat-shrunk film in the outermost portions of the upper and lower end faces.

The perforating jigs 8 and 8' used here have comb-like teeth 8*a* and a shape capable of forming perforations in the outermost portions of the upper end and lower end faces of the package at the boundary between the adjacent dry batteries. In particular, to prevent the dry batteries from being scratched by the teeth, the comb-like teeth were provided only at both ends of each of the perforating jigs 8 and 8' so that the teeth would not cut into the portion where the dry batteries contact each other.

Next, as shown in part (2) of FIG. 10, cutting jigs 5 having a V-shaped double-sided blade were moved up and down on the heat-shrunk film located on the upper end and lower end faces of the package at the boundary between the adjacent dry batteries, and slits 10 were formed in the heat-shrunk film located on the upper end and lower end faces.

Since the cutting jigs 5 used here were V-shaped blades having double-sided sharpened edges identical to the one shown in FIGS. 3 and 4, slits 10 were able to be formed near the contact portion of the two dry batteries without scratching their curved outer circumferential edges and surfaces at the end portions of the respectively contacting batteries (see part (3) of FIG. 10).

EXAMPLE 2

In this example, a package containing four AA size dry batteries was produced by wrapping the four dry batteries assembled in parallel in a heat-shrinkable film first, and by subsequently heat-shrinking the film around the batteries.

Figure 11:
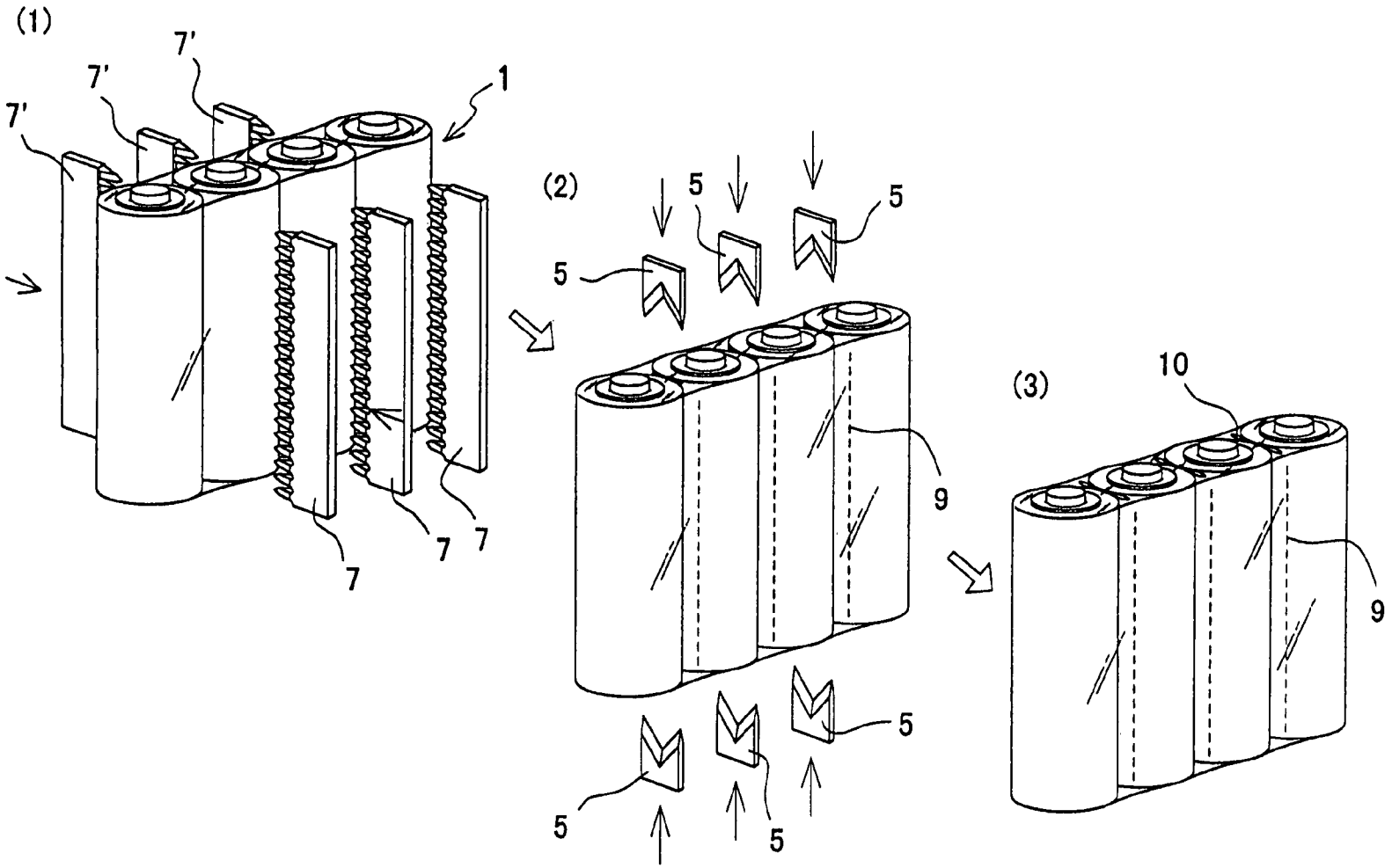
FIG. 11 is another schematic diagram for explaining the steps of forming perforations and slits in the package fabrication method in accordance with the present invention.

Next, the steps of forming perforations and slits shown in FIG. 11 were performed. FIG. 11 is a schematic diagram for explaining the steps of forming perforations and slits in the package fabrication method in accordance with the present invention.

First, as shown in part (1) of FIG. 11, first perforating jigs 7 and 7' were brought close to the sides of the package 1 containing the four dry batteries, and as shown in part (2) of FIG. 11, perforations 9 were formed along the boundaries between the adjacent dry batteries contained in the package 1. Here, since four dry batteries were packaged, there were three boundaries; therefore, three perforating jigs 7 and 7' were arranged on each side. The perforating jigs 7 and 7' have comb-like teeth 7*a* with which the perforations 9 are formed in the heat-shrunk film on the respective sides of the package 1. The size and pitch of the teeth were determined so that the perforations would not break and each individual cylindrical article would not be released when the package was dropped.

Next, as shown in part (2) of FIG. 11, cutting jigs 5 each having a V-shaped double-sided blade were moved up and down on the heat-shrunk film located at the upper end and lower end faces of the package at the boundaries between the adjacent dry batteries, and slits were formed in the heat-shrunk film at the upper and lower ends, as shown in part (3) of FIG. 11. Six cutting jigs 5 were used here.

Since the cutting jigs 5 used here were V-shaped blades having double-sided sharpened edges, slits 10 were able to be formed near the contact portions of the four dry batteries without scratching the curved outer circumferential edges and surfaces at the end portions of the respectively contacting batteries (see part (3) of FIG. 11).

Embodiment 2

Embodiment 2 of the present invention relates to a package for cylindrical articles, fabricated by wrapping a plurality of cylindrical articles assembled in parallel in a heat-shrinkable film, and heat-shrinking the film to fix and retain the articles, wherein the film has a slit on a side of the package along a boundary between adjacent ones of the articles, the film around the slit being curved in such a manner as to conform to outer circumferential surfaces of the cylindrical articles located adjacent to the boundary.

In Embodiment 2 of the present invention, the plurality of cylindrical articles assembled in parallel are wrapped together in a heat-shrinkable film such as a polyethylene terephthalate (PET) film, and the film is heat-shrunk to fix and retain the articles to complete the fabrication of the cylindrical article package. The most remarkable feature of this embodiment is that the film has a slit on a side of the package along the boundary between adjacent ones of the articles, and is curved in such a manner as to conform to the outer circumferential surfaces of the cylindrical articles located adjacent to the boundary.

A package for cylindrical articles and a fabrication method for the same in accordance with the present invention will be described below with reference to relevant drawings.

Figure 12:
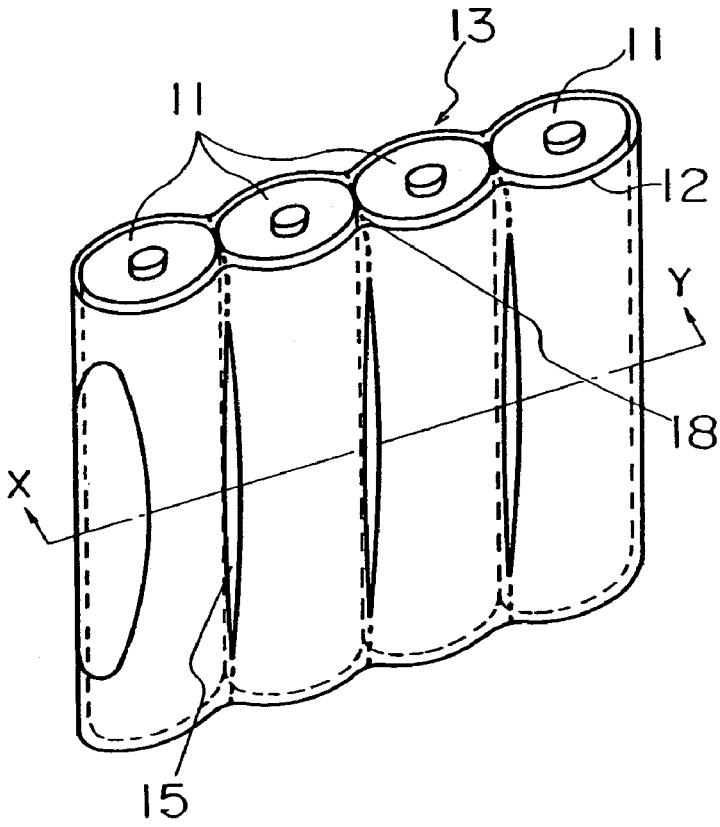
FIG. 12 is a schematic perspective view of a package for cylindrical articles, according to one embodiment of the present invention.

FIG. 12 shows a schematic perspective view of a package for cylindrical articles, according to one embodiment of the present invention. More specifically, FIG. 12 is a schematic perspective view of a package 13, which is fabricated by wrapping a plurality (in this example, four pieces) of cylindrical articles 11 assembled in parallel in a heat-shrinkable film 12, and heat-shrinking the film around the articles. The cylindrical articles 11 are fixed and retained in the package 13.

Figure 13:
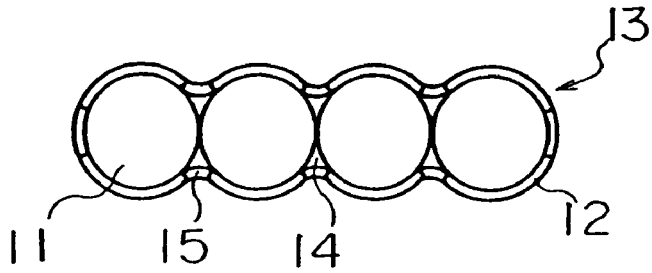
FIG. 13 is a schematic cross sectional view taken along the line X–Y in FIG. 12.

Next, FIG. 13 shows a schematic cross sectional view taken along the line X–Y in FIG. 12. As shown in FIG. 13, in the package 13 in accordance with the present invention, the heat-shrunk film 12 has a slit 15 along the boundary 14 between adjacent cylindrical articles 11, and the slit 15 is curved in such a manner as to conform to the outer circumferential surfaces of the cylindrical articles 11 located adjacent to the boundary 14.

Figure 14:
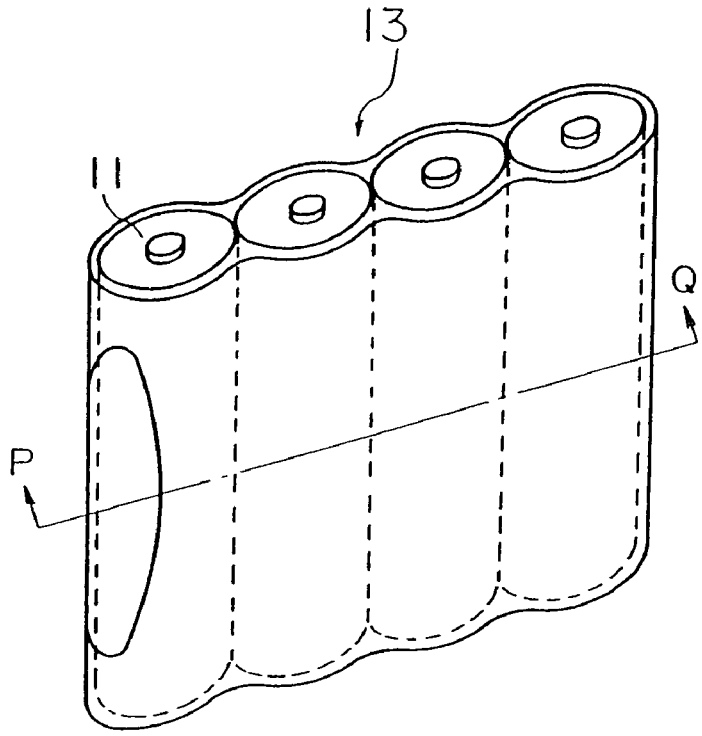
FIG.14 PRIOR ART
FIG. 14 is a schematic perspective view of a conventional package fabricated by wrapping cylindrical articles in a heat-shrinkable film.

Herein, a schematic perspective view of a conventional package fabricated by wrapping cylindrical articles in a heat-shrinkable film is shown in FIG. 14. A schematic cross sectional view taken along the line P–Q in FIG. 14 is shown in FIG. 15.

Figure 15:
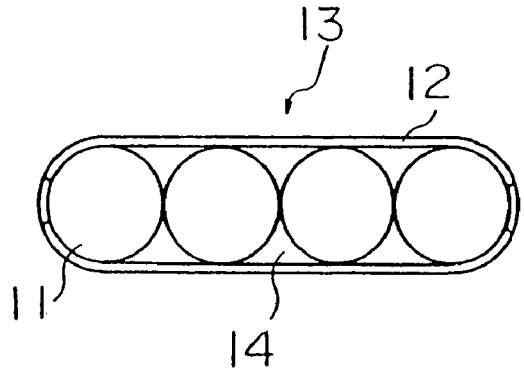
FIG.15 PRIOR ART
FIG. 15 is a schematic cross sectional view taken along the line P–Q in FIG. 14.

As shown in FIG. 14, the conventional package 13 does not have the slit that constitutes the feature of the present invention, and only a space is present in each boundary portion 14, as shown in FIG. 15.

Figure 16:
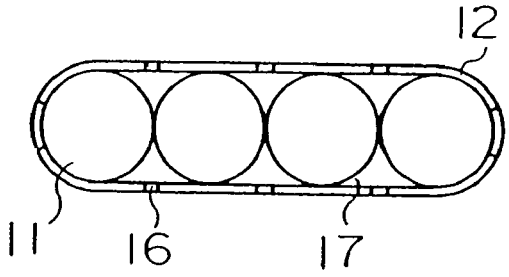
FIG.16 PRIOR ART
FIG. 16 is a diagram showing a package structure in which, in the conventional package of FIG. 15, an opening, such as a slit or perforation, is provided in the portion of the heat-shrunk film corresponding to each boundary between the cylindrical articles.

FIG. 16 shows a package structure in which, in the conventional package 13 of FIG. 15, an opening 16 such as a slit or perforation is simply provided in the portion of the heat-shrunk film 12 located at each boundary 14 between the cylindrical articles 11. The package shown in FIG. 16 is proposed to ensure the virginity of each individual cylindrical article 11.

However, as shown in FIG. 16, if the opening 16 is simply provided, the portion of the heat-shrunk film near the boundary is apart from the outer circumferential surfaces of the cylindrical articles, resulting in the formation of a gap 17. The presence of this gap 17 prevents the cylindrical articles 11 from being fixed and retained in the package with high reliability.

By contrast, in the present invention, no such gaps 17 are formed at either end of the boundary 14 because the heat-shrunk film 12 near the slit 15 is curved so as to conform to the outer circumferential surfaces of the cylindrical articles 11, as described above. As a result, it is possible to ensure the virginity of each individual cylindrical article 11, and fix and retain the cylindrical articles 11 in a reliable manner.

The slits 15 may be provided in the heat-shrunk film 12 on one side of the package 13 or on both sides thereof. When providing the slits on both sides, the area of the slits 15 as a whole should be kept small to prevent the cylindrical articles from loosening or falling out.

The dimensions of the slit 15 can be selected as desired within a prescribed range determined so that the cylindrical articles 11 would not fall out of the package 13 during normal handling of the package 13. In particular, it is preferable to dimension the slits so that the cylindrical articles 11 would not fall out of the package 13 even when the package 13 is dropped.

Herein, it is preferable that an adhesive layer is provided at least on the inner surface of the film on a periphery of the slit, and it is further preferable that the adhesive layer is made of a heat sensitive adhesive agent.

With the provision of the adhesive layer, the curved portions of the heat-shrunk film around the slit can be reliably affixed to the outer circumferential surfaces of the cylindrical articles. The curved portions of the heat-shrunk film can also be prevented from deforming due to changes in temperature or humidity or from gradually returning to the original shape over time. As a result, in the package comprising the cylindrical articles retained in the heat-shrunk film, the stress applied to perforated portions connecting the individual cylindrical articles is relieved, serving to prevent the cylindrical articles from falling out. Furthermore, since the curved portions of the heat-shrunk film is prevented from deforming and becoming loose, neat appearance can be retained.

In particular, forming the adhesive layer from a heat sensitive adhesive agent has the advantage of improving workability when wrapping the cylindrical articles in a heat-shrinkable film, since the heat sensitive adhesive agent before heated is normally not adhesive.

For the heat sensitive adhesive agent, a mixture of an ethylene-vinyl acetate copolymer, chlorinated polyolefin, amide wax, paraffin wax, epoxy resin, and dicyclohexyl phthalate can be preferably used.

In the package 13 of the present invention, it is preferable to form a perforation 18 for connecting the slit 5 formed on one side to the slit (not shown) formed on the other side, as shown in FIG. 12.

Further, it is effective that slits are formed in the heat-shrinkable film located on the upper end and lower end faces at the boundary between the adjacent cylindrical articles by means of a V-shaped or U-shaped cutting jig with a double-sided blade.

With the provision of the perforation 18, each individual cylindrical article 11 can be easily removed from the package 13. Furthermore, when removing one cylindrical article 11, it is possible to prevent unnecessary force from being applied to the remaining cylindrical articles 11, thus ensuring that the articles remain fixed and retained in the package.

Further, when the slit 15 is formed in the heat-shrunk film 12 on one side of the package 13, it is preferable to form a perforation on the other side in such a manner as to connect both ends of the slit 15.

The dimensions of the perforation, such as the length of the perforation and the size of each dot, can be selected appropriately according to the previously described dimensions of the slit 15 within a range determined so that the cylindrical articles 11 would not fall out of the package 13 during normal handling of the package 13. As previously described, it is particularly preferable to determine the dimensions so that the individual cylindrical articles 11 would not fall out of the package 13 even when the package 13 is dropped.

The heat-shrinkable film before the production of the package of the invention may be supplied in the form of a sheet or a tube. From the standpoint of facilitating the wrapping of the cylindrical articles by the heat-shrinkable film, it is preferred that the film be supplied in the form of a sheet.

If the heat-shrinkable film is in the form of a sheet, the ends of the film must be thermally welded in order to wrap the cylindrical articles. Generally, the welded portion is positioned at the bottom of the package.

Figure 17:
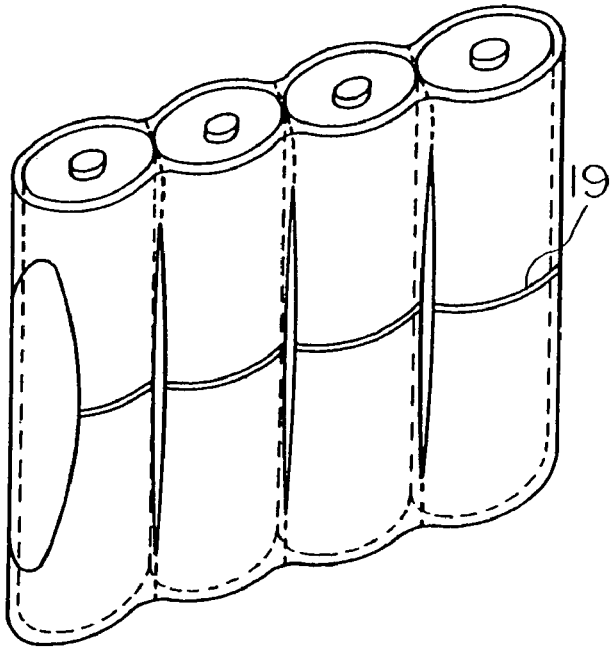
FIG. 17 is a schematic perspective view of a package for cylindrical articles, according to another embodiment of the present invention.

In the present invention, on the other hand, the welded portion may be positioned on one side of the package. This is shown in FIG. 17. FIG. 17 is a schematic perspective view of another example of the package 13 of the invention shown in FIG. 12; in this example, the welded portion 19 is positioned on one side of the package 13.

Next, a method of fabricating the package according to Embodiment 2 of the present invention will be described. The package fabrication method comprises the steps of: (A) forming the slit and perforation in the heat-shrinkable film in such a manner that the slit and the perforation are located in designated positions along the boundary between the adjacent articles; (B) wrapping the plurality of articles assembled in parallel in the film; (C) cutting the film; (D) heat-shrinking the film, which wraps the articles; and (E) curving portions of the heat-shrinkable film lying along the boundary in such a manner as to conform to the outer circumferential surfaces of the articles.

The order of these steps is not specifically limited as long as the effect of the present invention is not impaired. However, in the case of using a tube-like heat-shrinkable film, it is preferable to perform the step (A) after wrapping the cylindrical articles in the film, because it is difficult to insert the cylindrical articles into the tube, as described above.

(1) When the Heat-Shrinkable Film is Processed in Advance

Figure 18:
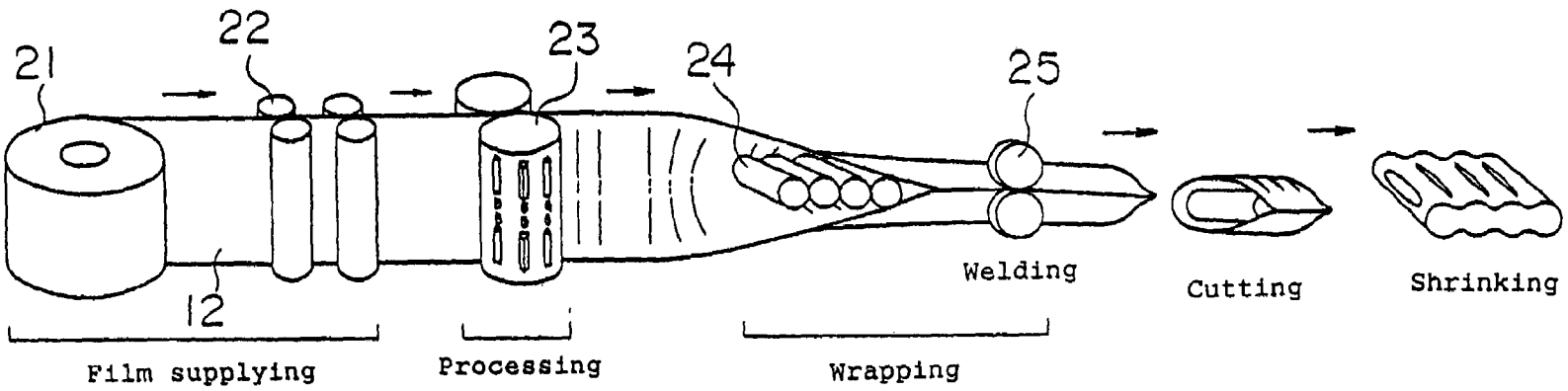
FIG. 18 shows a process diagram illustrating a package fabrication method in accordance with the present invention.

FIG. 18 shows a process diagram illustrating the package fabrication method of the present invention.

In this example, a sheet-like heat-shrinkable film is used, and slits and perforations are formed in the heat-shrinkable film in advance. The process shown in FIG. 18 is one example of the invention, and the invention is not limited thereto.

In the package fabrication method of the present invention shown in FIG. 18, the heat-shrinkable film 12 is pulled out from a supply roll 21 by means of rollers 22, and fed to a roll cutter 23 for forming slits and perforations (step (A)).

Figure 19:
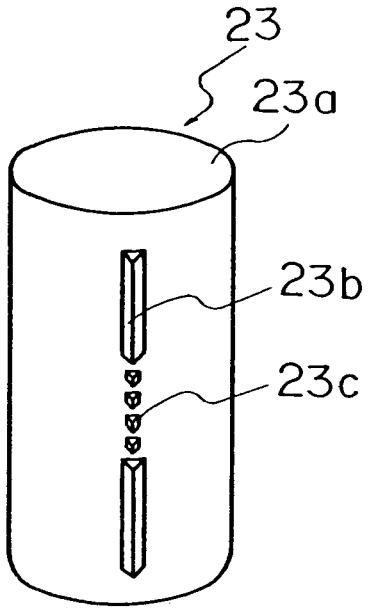
FIG. 19 is a schematic perspective view of a roll cutter used in the present invention.

FIG. 19 shows a schematic perspective view of the roll cutter 23. A slit forming blade 23*b* and a perforating blade 23*c* are provided on the circumference of the roll 23*a*. The dimensions of these blades 23*b* and 23*c* should be determined by considering the heat-shrinking rate of the heat-shrinkable film so that when the whole process is completed, the slits and perforations are located at designated positions corresponding to the boundaries between the cylindrical articles wrapped in the package.

The slits and perforations can also be formed using a laser or various cutters described later. However, when using a cutter, means for controlling the cutter motion must be made precise to enhance positioning accuracy by considering such factors as the heat-shrinking rate of the heat-shrinkable film.

Instead of the roll cutter method shown in FIGS. 18 and 19, a so-called plate cutter method may be used to form the slits and perforations.

Figure 20:
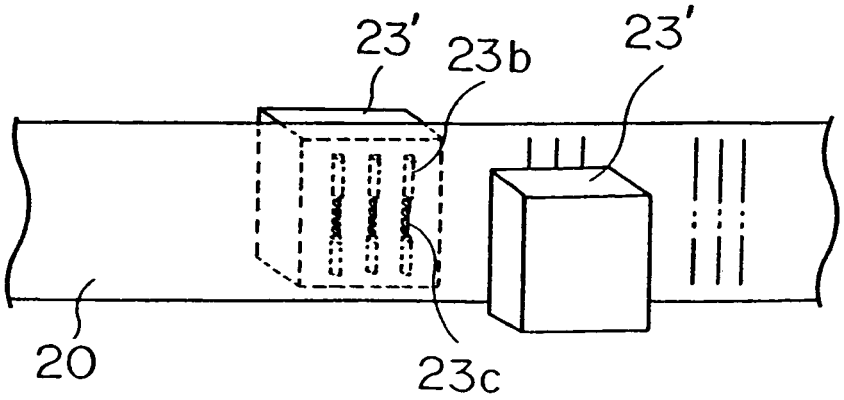
FIG. 20 is a schematic diagram showing how slits and perforations are formed in a heat-shrinkable film by using a plate cutter in the present invention.

FIG. 20 is a diagram showing how the slits and perforations are formed in the heat-shrinkable film by using a plate cutter 23. The plate cutter 23' having a slit forming blade 23*b* and a perforating blade 23*c* is positioned on the both surfaces of the supplied heat-shrinkable film 20 respectively, and pressed against the heat-shrinkable film 20 to form the slits and perforations.

In this case, if the plate cutter 23' is arranged only on one side of the heat-shrinkable film 20, unnecessary force is applied to the heat-shrinkable film 20 during pressing, which is not desirable; therefore, as shown in FIG. 20, plate cutters 23' may be arranged on both sides of the heat-shrinkable film 20 in alternating manner.

Further, it is relatively difficult to form a perforation especially in the lower end face of the package corresponding to the bottom side of the cylindrical articles. However, the perforation in the lower end face can be formed by controlling the operation of the various cutters described above. Alternatively, a special perforating die may be used. Perforations can also be formed by sandwiching the package from both sides of the cylindrical articles by means of a pair of dies; the details of this method will be described later.

As shown in FIG. 18, a set 24 of cylindrical articles assembled in parallel is wrapped by the heat-shrinkable film 20 thus processed. At this time, positioning must be done by considering such factors as the heat-shrinking rate of the heat-shrinkable film so that the slits and the perforations will be located at the boundary of adjacent cylindrical articles (step (B)).

Next, the both ends of the heat-shrinkable film are welded together using, for example, a heated heat roller. The welding means used here is not limited to the heat roller, and an ultrasonic wave may also be used.

Then, as shown in FIG. 18, the heat-shrinkable film is cut according to the dimensions of the set 24 of cylindrical articles (step (C)), and heat is applied to heat-shrink the heat-shrinkable film (step (D)), thereby fixing and retaining the individual cylindrical articles.

Finally, the step (E) is performed, in which the portions of the heat-shrunk film lying in the boundary portion are caused to curve in such a manner as to conform to the outer circumferential surfaces of the cylindrical articles.

Various methods can be employed in the step (E).

(i) Hot Air Method

In this method, the step (E) is performed by passing the cylindrical article package with the slits and perforations formed therein through an oven capable of generating hot air. The hot air causes the shrunk film to shrink further, thus causing the slit portion to curve along the outer circumferential surfaces of the cylindrical articles. In particular, when the slit is formed extending nearly to the upper and lower ends along the longitudinal direction of the cylindrical articles, the slit portion of the film is in the idle state; therefore, the film automatically shrinks along the outer circumferential surfaces of the cylindrical articles by just blowing hot air. This method, therefore, does not require complicated production equipment.

(ii) Heated Die Method

In this method, the step (E) is performed by heating a die having a shape the fits the package containing the cylindrical articles, and by sandwiching the package with the die.

Figure 21:
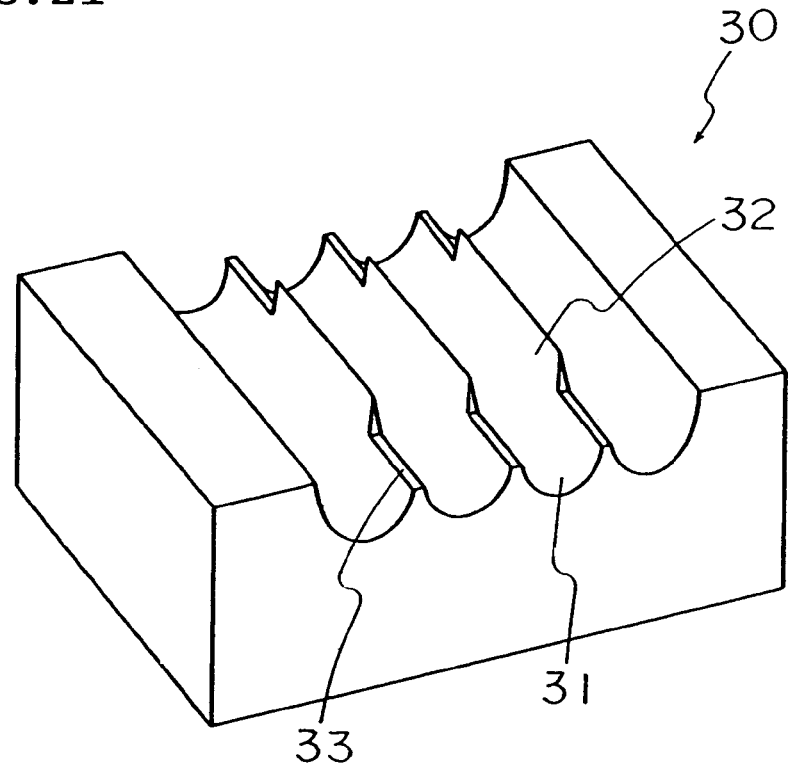
FIG. 21 is a schematic perspective view of a heated die used in the present invention.
Figure 22:
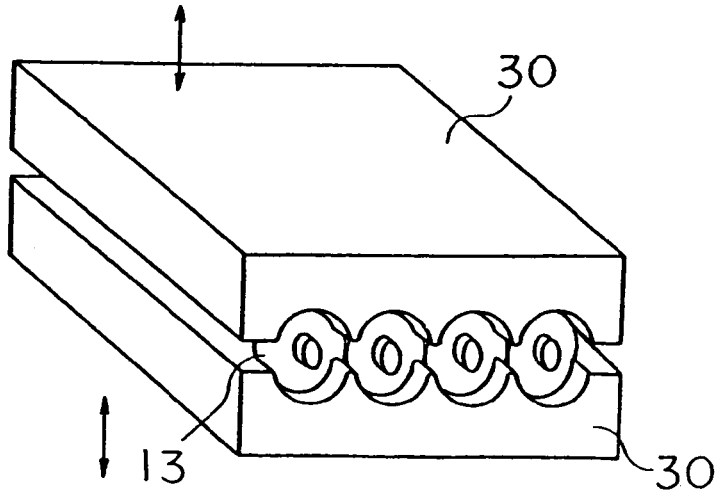
FIG. 22 is a schematic diagram illustrating a method of forming slits by using the heated die in the present invention.

FIG. 21 shows a schematic perspective view of the heated die used here. FIG. 22 is a schematic diagram illustrating a method of forming slits by using a heated die in the present invention.

As shown in FIG. 21, a heated die 30 includes a cylindrical article holding recess 31 and a slit forming protrusion 32; the structure is such that when the package is sandwiched from both sides thereof as shown in FIG. 22, the slit portions of the heat-shrunk film are caused to curve conforming to the outer circumferences of the cylindrical articles.

In FIG. 22, the holding recess 31 has a shape that fits the outer shape of the cylindrical articles, and the slit forming projection 32 is designed to cut into the boundary portions between the respective adjacent cylindrical articles in the package, thereby forming a slit in the boundary portion while, at the same time, causing the slit portion to curve, when the package is sandwiched under pressure.

Examples of the material forming the heated die 30 include a metal such as iron, aluminum, or copper. From the standpoint of ensuring good contact between the heat-shrinkable film and the cylindrical articles and providing good mold release and cushioning characteristics, it is preferable to provide a coating layer, made of a fluorocarbon resin such as Teflon or an elastic material such as silicone rubber or heat resistant rubber, on the interior surfaces of the heated die 30 that contact the cylindrical articles.

Also, the heated die 30 is heated using a heat source such as a heater.

The package for cylindrical articles in accordance with the present invention can be fabricated as described above.

(2) When the Heat-Shrinkable Film is Processed After Wrapping Cylindrical Articles In this method, as in conventional ones, the set of cylindrical articles is wrapped in the heat-shrinkable film (step (B)); the heat-shrinkable film is cut according to the dimensions of the cylindrical article set after thermally welding the ends of the film (step (C)); and heat is applied to heat-shrink the heat-shrinkable film (step (D)), thereby fixing and retaining the individual cylindrical articles.

In this case, the slits and perforations are formed in the heat-shrinkable film, either before or after heat-shrinking, in such manner that the slits and the perforations will be located at designated positions in the boundary portions between the adjacent cylindrical articles (step (A)).

In this case, various methods can be used for the formation of the slits and perforations, and for example, the following methods may be used.

(i) Cutter Method

In this method, the slits and perforations are formed using cutters of various shapes. FIGS. 23 to 26 show side views of cutters that can be used in this method.

Figure 23:
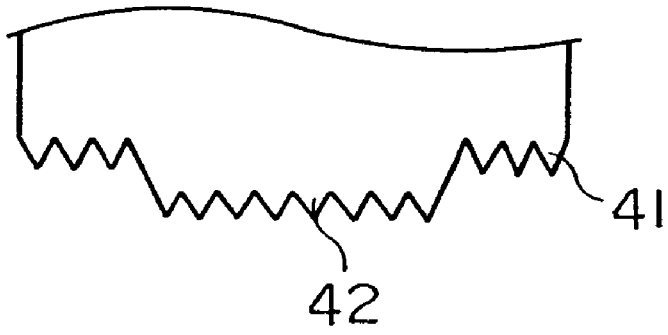
FIG. 23 is a side view of a cutter used in the present invention.
Figure 24:
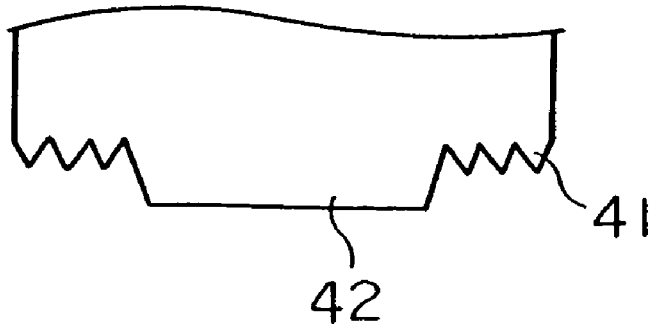
FIG. 24 is a side view of another cutter used in the present invention.

The cutters 40 shown in FIGS. 23 and 24 have two blades, and the slits and perforations are formed utilizing the height gap between the two blades.

In the case of the cutter shown in FIG. 23, both the perforating blade 41 and the slit forming blade 42 comprise sawtooth cutting edges. When using this cutter, the slits and perforations can be formed by pressing the cutter 40 against the heat-shrinkable film of the package.

In the case of the cutter 40 shown in FIG. 24, the perforating blade 41 comprises sawtooth cutting edges, while the slit forming blade 42 comprises a straight cutting edge. When using this cutter 40, also, the slits and perforations can be formed by pressing the cutter 40 against the heat-shrinkable film of the package.

Figure 25:
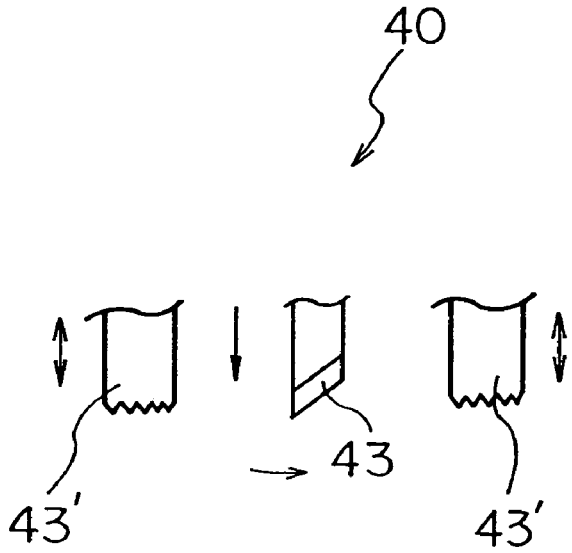
FIG. 25 is a side view of another cutter used in the present invention.
Figure 26:
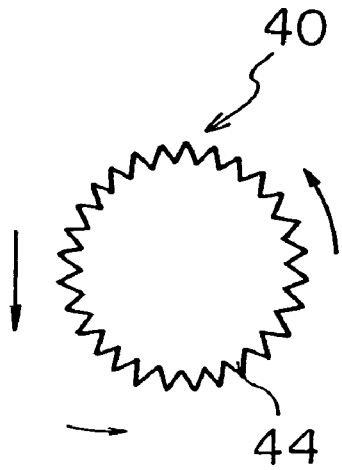
FIG. 26 is a side view of another cutter used in the present invention.

In the case of the cutters 40 shown in FIGS. 25 and 26, the slits and perforations are formed by controlling the motion of the cutter.

The cutter 40 shown in FIG. 25 comprises a knife edge blade 43 and sawtooth blades 43'. When forming the slits and perforations using this cutter 40, the sawtooth blades 43' for forming perforations are moved up and down on the heat-shrinkable film by computer-controlling the cutter 40, while the knife edge blade 43 for forming slits is caused to slide in the horizontal direction on the heat-shrinkable film.

In this case, the cutter 40 may be moved while fixing the package, or the package may be moved while fixing the cutter. However, when sliding the cutter, the cutter height must be controlled precisely so as not to scratch the cylindrical articles because the space between the heat-shrinkable film and the cylindrical articles is small.

The cutter 40 shown in FIG. 26 comprises a disc-shaped sawtooth blade 44. When using this cutter, the cutter 40 is brought close to the heat-shrinkable film and is rotated in such a manner as to slide on the film to form a perforation therein. At this time, the height must be controlled so that the cutting edges of the sawtooth blade 44 do not penetrate through the heat-shrinkable film. Then, subsequently, a slit is formed by pressing the cutter 40 on the heat-shrinkable film until the cutting edges of the sawtooth blade 44 penetrate through the film. After that, a perforation is formed in the same manner as described firstly.

Figure 27:
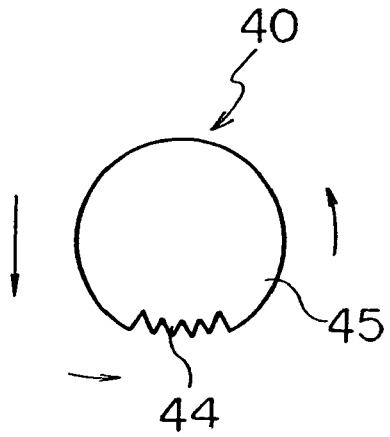
FIG. 27 is a side view of another cutter used in the present invention.

The cutter 40 shown in FIG. 27 is a disc-shaped cutter having a sawtooth blade 44 for forming perforations and a straight blade 45 for forming slits. When using this cutter, once the heights of the sawtooth blade 44 and the straight blade 45 are adjusted with respect to the heat-shrinkable film, slits and perforations can be formed by rotating and sliding the cutter.

(ii) Die Method

This method uses a die having a similar shape to that shown in FIG. 21.

Figure 28:
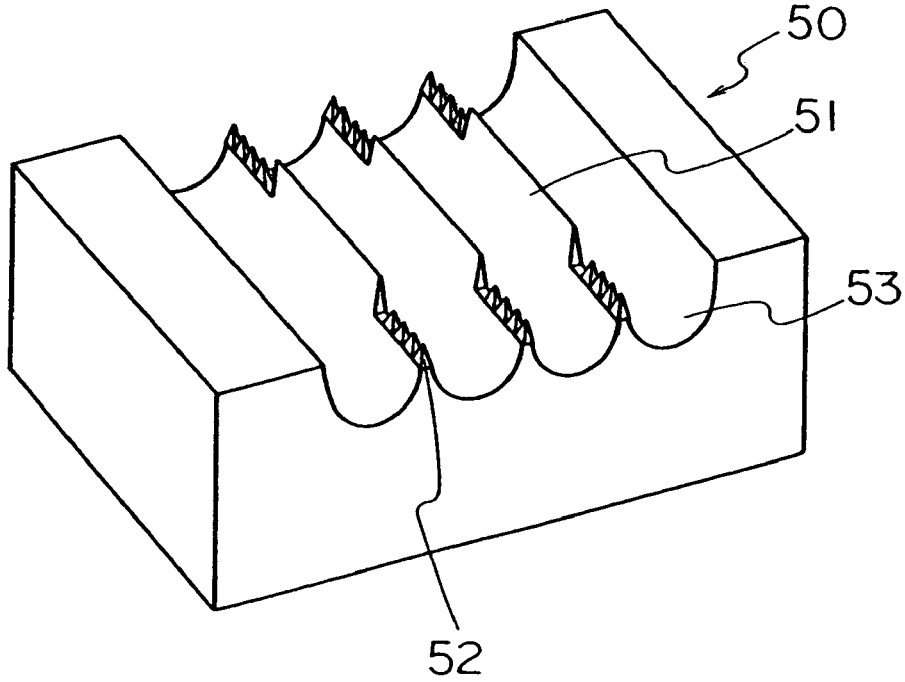
FIG. 28 is a schematic perspective view of a die used in the present invention.

FIG. 28 shows a schematic perspective view of the die used here. The die shown in FIG. 28 has recesses for holding cylindrical articles, and by sandwiching the package as shown in FIG. 22, slits and perforations can be formed in the heat-shrinkable film of the package by means of the slit forming blades 51 and perforating blades 52.

Using this die offers the advantage that the subsequent curving step (E) can be accomplished simultaneously by heating the die itself.

When forming slits and perforations in the film already heat-shrunk to form a package, it is relatively difficult to form perforations in the upper end and lower end of the package corresponding to the upper and lower ends of the cylindrical articles packed therein. The perforations in the upper end and lower end can be formed by controlling the motion of the various cutters described above, but by sandwiching the package from the top and bottom and from the front and back by means of respective pairs of dies, the slits and perforations can all be formed in a single operation.

Alternatively, the slits and perforations can be formed using a laser beam.

Finally, the step (E) is performed, in which the portions of the heat-shrunk film lying in the boundary portion are caused to curve in such a manner as to conform to the outer circumferential surfaces of the cylindrical articles.

The package for cylindrical articles in accordance with the present invention can be fabricated as described above.

The method of fabricating the cylindrical article package according to Embodiment 2 of the present invention has been described above, but it will be appreciated that various design changes can be made according to the shape of the heat-shrinkable film used as the material, the existing package fabrication equipment, the cost of fabrication, the kinds of available technical means and the like, as long as the above-described steps (A) to (E) are included.

The step of forming the adhesive layer at least on inner surface of the film on a periphery of the slit can be performed at any point of time before the curving step (E) in the fabrication process.

Next, a set of cylindrical article package will be described.

These days, cylindrical article packages fabricated as described above in accordance with the present invention may often be sold in a plurality of sets.

Accordingly, it can be said that a demand exists for packaged sets containing a plurality of such packages.

In view of this, the present invention also provides a packaged set containing a plurality of packages each retaining therein one or a plurality of cylindrical articles, the packaged set being fabricated by wrapping a set of the plurality of packages in a second heat-shrinkable film and by heat-shrinking the second heat-shrinkable film around the set of the packages. The method of fabricating the packaged set by wrapping the plurality of packages in the second heat-shrinkable film and by heat-shrinking the film around the set of the packages can be carried out in fundamentally the same way as the method of fabricating the package for the plurality of cylindrical articles described above.

Accordingly, for the second heat-shrinkable film, it is also preferable to form a slit in the boundary portion between adjacent packages.

It is also possible to produce a packaged set of cylindrical article packages by blister-packing the set of the packages each retaining therein one or a plurality of cylindrical articles.

The blister pack can be fabricated using a conventionally known method. For example, the plurality of cylindrical article packages are placed on a backing sheet, and covered with a transparent plastic cover having a recess shaped to fit the outer shape of the packages. Then, the peripheral portion of the plastic cover is bonded to the sheet.

It is also possible to produce a packaged set of cylindrical article packages by skin-packing the set of the packages each retaining therein one or a plurality of cylindrical articles.

The skin pack can also be fabricated using a conventionally known method. For example, a cover film made of a transparent thermoplastic resin is placed over the set of the packages arranged on a backing sheet having a large number of micro through-holes passing therethrough, and the whole set of packages is vacuumed from behind the sheet while heating the cover film.

Embodiment 3

Embodiment 3 of the present invention relates to a composite package in which a plurality of packages, each fixing and retaining a plurality of batteries assembled in parallel in a first heat-shrinkable film, are fixed and retained in parallel in a second heat-shrinkable film, wherein at least one pore is formed in the second heat-shrinkable film in a portion thereof corresponding to an end portion of a boundary between the packages.

The inventors have conducted extensive studies on double shrink packages and have found that the problems associated with the prior art can be solved by employing the above structure.

More specifically, in accordance with the present invention, in a package in which a plurality of unit packages, each fixing and retaining a plurality of batteries assembled in parallel in a first heat-shrinkable film, are fixed and retained in parallel in a second heat-shrinkable film, at least one pore is formed in the second heat-shrinkable film in a portion thereof corresponding to an end portion of the boundary between the unit packages.

Because of the presence of this pore, when the package is bent or twisted, the second heat-shrinkable film is easily torn out starting at the pore. The invention thus provides the effect of permitting easy opening of the package.

Here, the pore is formed in an end portion of the boundary because when opening the package by twisting it, shearing force tends to be applied to the pore in a linear direction parallel to the boundary line, making the second heat-shrinkable film easier to tear out.

Also, when opening the package by just bending it, since the second heat-shrinkable film is curved in a portion near the end portion of the boundary, shearing force likewise tends to be applied to the pore in the linear direction along the boundary line, making the second heat-shrinkable film easier to tear out.

Accordingly, the exact position of the end portion in which the pore is to be formed is determined according to the dimensions of the batteries in the package.

The composite package according to Embodiment 3 of the present invention will be described below with reference to relevant drawings.

Figure 29:
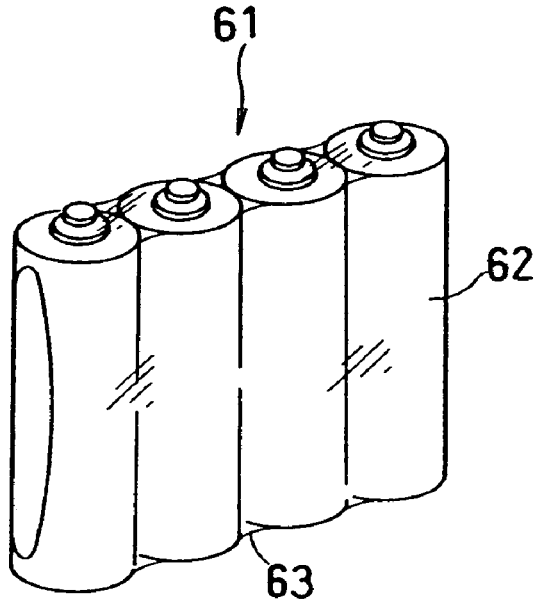
FIG. 29 is a schematic perspective view of a unit package in the present invention.

FIG. 29 is a schematic perspective view of a unit package. The unit package 61 shown in FIG. 29 is fabricated by assembling four cylindrical batteries 62 in parallel, wrapping them together in a first heat-shrinkable film 63, and heat-shrinking the film to form a package. At this time, in the first heat-shrinkable film wrapped around the unit package, a perforation may be formed for each battery as previously described.

The unit package in the present embodiment may be the same as the package described in the above Embodiments 1 and 2.

That is, the unit package may be the one fabricated by wrapping a plurality of cylindrical articles assembled in parallel in a heat-shrinkable film, and heat-shrinking the film to fix and retain the articles, wherein the film has a slit in at least either one of an upper end face and a lower end face of the package corresponding to an upper end and a lower end of the adjacent cylindrical articles in a portion thereof corresponding to a boundary between the adjacent cylindrical articles.

The unit package may also be the one fabricated by wrapping a plurality of cylindrical articles assembled in parallel in a heat-shrinkable film, and heat-shrinking the film to fix and retain the articles, wherein the film has a slit on a side of the package along a boundary between the adjacent articles, and is curved in such a manner as to conform to outer circumferential surfaces of the cylindrical articles located adjacent to the boundary.

In this case, it is effective that the package includes an adhesive layer at least on inner surface of the film on a periphery of the slit and the adhesive layer is made of a heat sensitive adhesive agent.

Also, it is preferable that the slit is formed in the film on each side of the package, and is dimensioned within a prescribed range determined so that each individual cylindrical article does not fall out of the package even when the package is dropped.

Further, it is effective that the package is provided with a perforation that connects the slit formed on one side of the package to the slit formed on the other side of the package.

Also, the slit may be formed in the film on one side of the package, and a perforation connecting both ends of the slit is formed in the film on the other side of the package.

It is also effective to use a film in the form of a sheet as the film, form a welded portion thereto to wrap the articles together, and further position the welded portion on one side of the package. As the film, a film in the form of a tube may be used.

This unit package can be fabricated according to the methods described in the above Embodiments 1 and 2.

Figure 30:
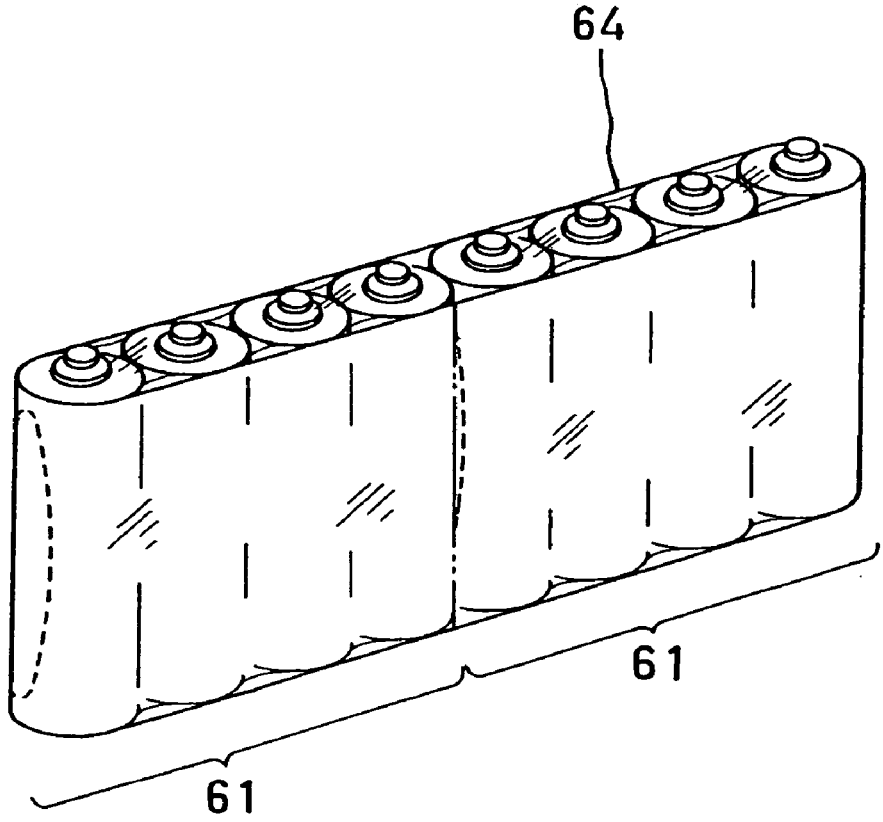
FIG. 30 is a schematic perspective view of a package containing a plurality of unit packages.
Figure 31:
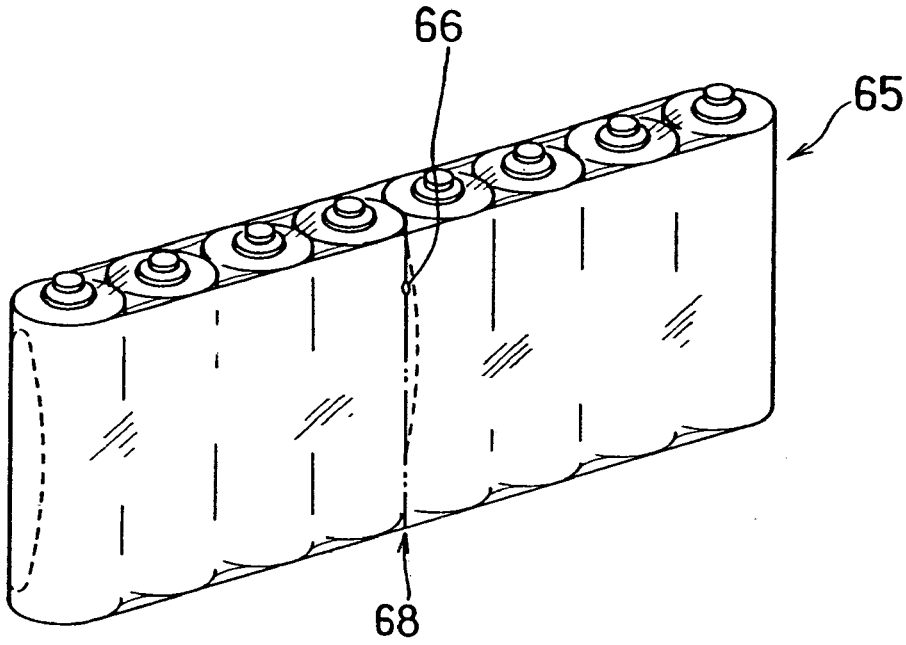
FIG. 31 is a schematic perspective view of a package in accordance with the present invention.

Each of FIGS. 30 and 31 shows a schematic perspective view of a composite package containing a plurality of unit packages. As shown in FIG. 30, two unit packages 61 assembled in parallel are wrapped in a second heat-shrinkable film 64, and the film is heat-shrunk to wrap the packages. For the sake of clarity, the first heat-shrinkable film forming each unit package 61 is omitted in FIG. 30.

FIG. 31 shows a schematic perspective view of the composite package in accordance with the present invention. The composite package 65 shown in FIG. 31 has one pore 66 in an end portion of the boundary between the two unit packages 61.

Figure 32:
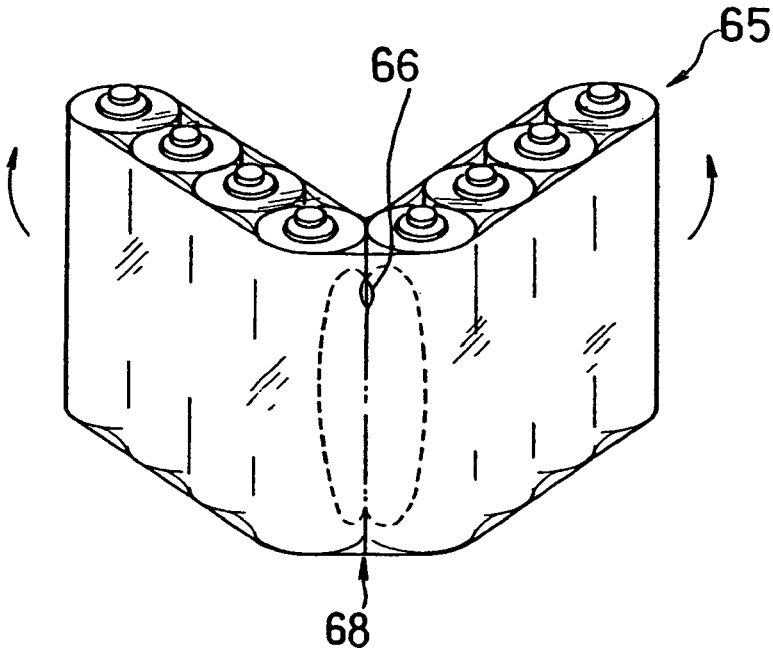
FIG. 32 is a schematic perspective view illustrating a method of opening the package of the present invention shown in FIG. 31.

With the provision of this pore 66, the composite package 65 offers the following effect. That is, when the composite package 65 is lightly bent, for example, at the boundary between the unit packages, as shown in FIG. 32, the second heat-shrinkable film 64 begins to tear out starting at the pore 66. Then, the composite package 65 can be easily opened to remove each unit package 61.

FIG. 32 is a schematic perspective view showing how the composite package 65 in accordance with the present invention is opened. When the composite package 65 is bent at the boundary between the unit packages 61, as shown in FIG. 32, the second heat-shrinkable film begins to tear out starting at the pore 66.

In the composite package 65 shown in FIG. 31, the pore 66 is provided only on one side of the composite package. As shown in FIG. 32, the pore 66 should be provided only on the side that protrudes when the composite package 65 is bent, but it may be provided on the opposite side.

Further, in the composite package 65 shown in FIG. 31, the pore is provided only in one end portion (upper end portion) of the boundary between the two unit packages 61. However, to achieve easier opening, the pore may also be provided in the lower end portion.

Figure 33:
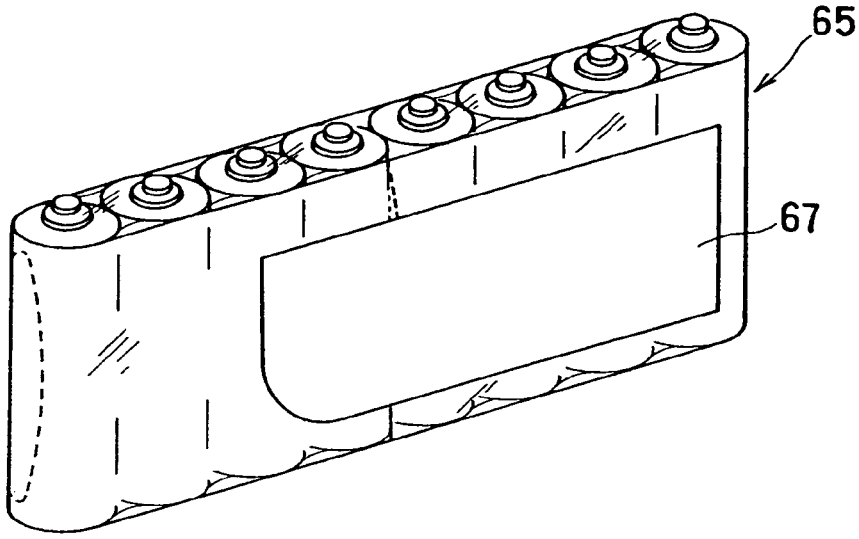
FIG. 33 is a schematic perspective view of another package in accordance with the present invention.

As shown in FIG. 33, a label 67 may be affixed to the exterior surface of the second heat-shrinkable film on the side of the composite package 65 opposite to the side on which the pore is provided. This configuration has the effect of facilitating the opening of the composite package 65, because when the package is bent or twisted, the label 67 functions as a cutting tape.

In the present invention, the number of cylindrical batteries contained in each unit package and the number of unit packages contained in the composite package are not specifically limited, and can be changed as desired according to the dimensions and weights of the batteries within the scope that does not impair the effect of the invention.

Figure 34:
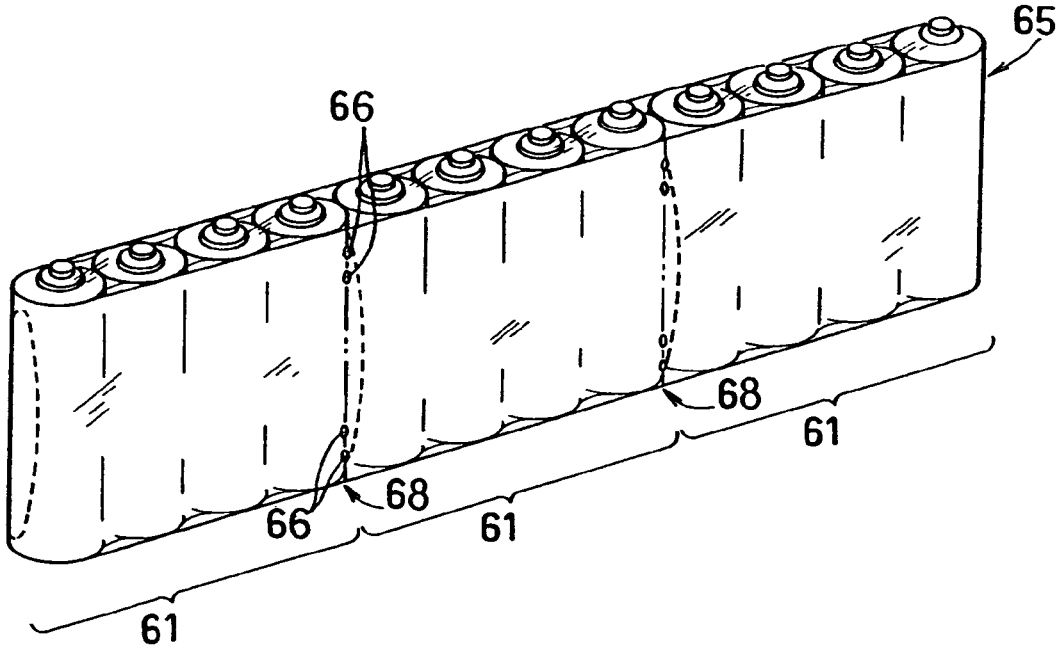
FIG. 34 is a schematic perspective view of still another package in accordance with the present invention.

FIG. 34 is a schematic perspective view of another composite package in accordance with the present invention, which contains three unit packages 61. Two pores 66 are provided in each of the upper and lower end portions of the boundary between adjacent unit packages 61.

Figure 35:
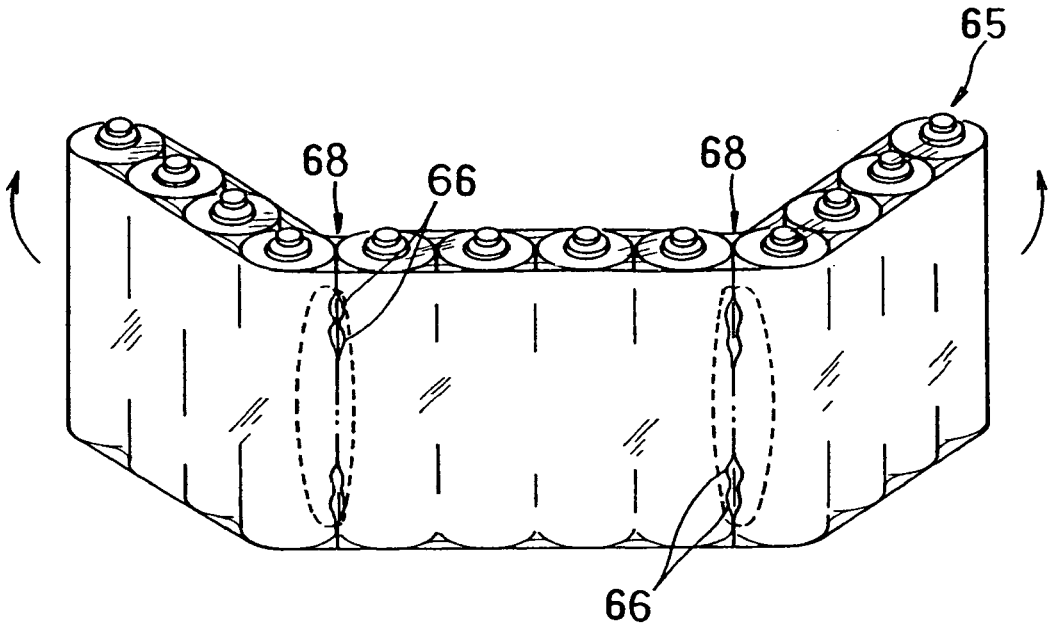
FIG. 35 is a schematic perspective view illustrating a method of opening the package of the present invention shown in FIG. 34.

FIG. 35 is a schematic perspective view for explaining how the composite package shown in FIG. 34 is opened. When two of the pores 66 are provided in each of the upper end and lower end portions of the boundary 68 as shown in FIG. 34, opening of the composite package is facilitated because, when the composite package 65 is bent at the boundary 68 as shown in FIG. 35, the second heat-shrinkable film begins to tear out efficiently at the pores 66.

In the present invention, the pores can take various shapes such as slit, pinhole and circle, but from the standpoint of maintaining secure fixation and retention of the plurality of unit packages, it is preferable to form the pore as pinhole circular in shape. By at least providing a pore as pinhole, the pore can serve as a point at which the second heat-shrinkable film begins to tear out.

More specifically, it is preferable that the pore be formed by sticking a needle into the second heat-shrinkable film in the designated position. The diameter of the needle is not specifically limited, but it may be around 0.5 mm to 1.5 mm.

Next, the designated position in which the pore is formed, that is, the portion of the second heat-shrinkable film that corresponds to an end portion of the boundary between the unit packages, will be described.

The designated position varies depending on such factors as the shape, dimensions, quantity and the like of the unit packages contained in the composite package of the invention and the shape, dimensions, quantity and the like of the battery contained in each unit package. Therefore, by considering the above factors, any person skilled in the art is able to determine such designated position within the scope that does not impair the effect of the invention that the plurality of unit packages are stably fixed and retained.

Further, to obtain the composite package of the present invention, performance requirements of the first and second heat-shrinkable films must be appropriately selected.

First, since the second heat-shrinkable film is shrunk by heating after fabricating the unit packages with the first heat-shrinkable film, it would be undesirable if the first heat-shrinkable film were deformed when heating the second heat-shrinkable film. Therefore, it is preferable that the melting point of the first heat-shrinkable film be higher than that of the second heat-shrinkable film.

Further, since the total weight of the plurality of unit packages is considerably large, the load applied to the second heat-shrinkable film is larger than that applied to the first heat-shrinkable film. It is therefore preferable that the second heat-shrinkable film has greater strength and larger elongation after fracture than the first heat-shrinkable film.

As for the specific kinds of the first and second heat-shrinkable films, any person skilled in the art is able to select appropriate kinds of films within the scope that satisfies the above performance requirements and that does not impair the effect of the invention or the inherent effect of the composite package for batteries.

For example, a polyethylene terephthalate (PET) film (melting point: about 250° C.) can be used for the first heat-shrinkable film. In this case, the thickness is preferably 20 to 35 $\mu$m, tensile strength at break is preferably 8000 to 10000 PSI (55 to 69 N/mm$^2$), and tensile elongation at break is preferably 60 to 160%.

On the other hand, a three-layer heat-shrinkable film consisting of polypropylene (PP), polyethylene (PE), and polypropylene (PP) layers (melting point of PP: about 160° C.) can be used for the second heat-shrinkable film. The thickness is preferably 13 to 30 $\mu$m, tensile strength at break is preferably 11000 to 20000 PSI (76 to 138 N/mm$^2$), and tensile elongation at break is preferably 60 to 160%.

The present invention will be described in further detail below by way of example, but it is not limited thereto.

EXAMPLE 3

First, a unit package of the structure shown in FIG. 29 was fabricated by arranging four AA size alkaline dry batteries (LR6) in parallel, wrapping them together in a first heat-shrinkable film of polyethylene terephthalate (PET) (thickness: 30 $\mu$m, tensile strength at break: 9000 PSI (62 N/mm$^2$), and tensile elongation at break: about 90%), and heat-shrinking the film to fix and retain the batteries. The film ends were thermally welded so that the welded portion was positioned only at the bottom side of the batteries.

Next, a package of the structure shown in FIG. 34 was fabricated by arranging three unit packages in parallel, wrapping them together in a three-layer heat-shrinkable film consisting of polypropylene (PP), polyethylene (PE), and polypropylene (PP) layers (thickness: 19 $\mu$m, tensile strength at break: 13000 PSI (90 N/mm$^2$), and tensile elongation at break: about 130%), and heat-shrinking the film to fix and retain the unit packages. The film ends were thermally welded so that the welded portion was positioned at three locations, namely, the bottom side of the unit packages and along the left and right sides of the left-hand side and right-hand side unit packages, respectively (the so-called pillow package).

Then, four pores were formed in each of the two boundary portions between the respective unit packages by sticking a 0.97-mm diameter needle at positions about 6 mm from the upper and lower edges of the batteries, to complete the fabrication of the composite package in accordance with the present invention.

When the thus fabricated composite package of the invention was bent as shown in FIG. 35 according to the package opening method previously described with reference to FIG. 32, the second heat-shrinkable film began to tear out at the pores, and the package was able to be opened easily.

Industrial Applicability

According to the cylindrical article package fabrication method of the present invention, a package for cylindrical articles such as batteries can be fabricated by easily forming perforations in suitable positions on the package without scratching or nicking the cylindrical articles.

The invention also provides a package for a plurality of cylindrical articles, wherein the cylindrical articles can be removed individually and, even when one cylindrical article is removed, the virginity of the remaining cylindrical articles can be ensured.

Furthermore, in accordance with the present invention, a composite package can be provided that allows each unit package to be removed by easily tearing out the outer film while reliably and stably retaining the fixed and retained state of each unit package.

Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure. Accordingly, it is intended that the appended claims be interpreted as covering all alterations and modifications as fall within the true spirit and scope of the invention.

We claim:

1. A method of fabricating a package for cylindrical articles, said package being fabricated by wrapping a plurality of cylindrical articles assembled in parallel in a heat-shrinkable film, and heat-shrinking said film to fix and retain the articles, said fabrication method comprising a step (a) of:

moving a V-shaped or U-shaped cutting jig with a double-sided blade up and down on said heat-shrinkable film located at an upper end face and/or a lower end face of said package corresponding to an upper end and/or a lower end of said cylindrical articles, and thereby forming slits in said heat-shrinkable film located at said upper end face and/or said lower end face at a boundary between said adjacent cylindrical articles.

2. The method of fabricating a package for cylindrical articles in accordance with claim 1, further comprising a step (b) of forming a perforation in said heat-shrinkable film located on a side of said package, in which said cylindrical articles are assembled in parallel, along said boundary between said adjacent cylindrical articles.

3. The method of fabricating a package for cylindrical articles in accordance with claim 1, further comprising a step (c) of forming a perforation in said heat-shrinkable film in outermost portions of said upper end and said lower end of said package along said boundary between said adjacent cylindrical articles.

4. The method of fabricating a package for cylindrical articles in accordance with claim 2, wherein said slit forming step (a) is performed after performing said perforation forming step (b).

5. The method of fabricating a package for cylindrical articles in accordance with claim 3, wherein said step (b) and said step (c) are performed simultaneously.

* * * * *